US008907256B2

(12) United States Patent
Hashimoto et al.

(10) Patent No.: US 8,907,256 B2
(45) Date of Patent: Dec. 9, 2014

(54) HEATER

(75) Inventors: Shigeharu Hashimoto, Okazaki (JP); Kenkichi Nagai, Nagoya (JP); Masahiro Kida, Yatomi (JP); Yoshiho Tomita, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 91 days.

(21) Appl. No.: 13/423,531

(22) Filed: Mar. 19, 2012

(65) Prior Publication Data

US 2012/0241439 A1 Sep. 27, 2012

(30) Foreign Application Priority Data

Mar. 24, 2011 (JP) ..... 2011-066645
Jun. 16, 2011 (JP) ..... 2011-134109
Jan. 31, 2012 (JP) ..... 2012-018868

(51) Int. Cl.
*H05B 3/10* (2006.01)
*F01M 5/00* (2006.01)
*F01M 5/02* (2006.01)

(52) U.S. Cl.
CPC ..... *F01M 5/00* (2013.01); *F01M 5/021* (2013.01)
USPC ..... 219/553

(58) Field of Classification Search
USPC ..... 219/553, 541; 428/116, 397.7; 427/397.7; 338/306–314
See application file for complete search history.

(56) References Cited

U.S. PATENT DOCUMENTS 3,995,143 A * 11/1976 Hervert ..... 219/553
4,972,197 A * 11/1990 McCauley et al. ..... 343/704
5,200,154 A * 4/1993 Harada et al. ..... 422/174
5,254,840 A * 10/1993 Thompson ..... 219/544
5,259,190 A * 11/1993 Bagley et al. ..... 60/300
5,266,278 A * 11/1993 Harada et al. ..... 422/174
5,463,206 A * 10/1995 Abe et al. ..... 219/553
5,519,191 A * 5/1996 Ketcham et al. ..... 219/552
5,628,928 A * 5/1997 Rolf ..... 219/488
5,651,088 A * 7/1997 Abe et al. ..... 392/494
5,664,049 A * 9/1997 Kondo et al. ..... 392/485
5,861,611 A * 1/1999 Kato et al. ..... 219/552
2003/0134084 A1* 7/2003 Ichikawa et al. ..... 428/116
2007/0189741 A1* 8/2007 Gruetzmann et al. ..... 392/485

FOREIGN PATENT DOCUMENTS

CN 101550855 A 10/2009
JP 63-012607 U 1/1988
JP 63-016114 A1 1/1988
JP 07-085952 A1 3/1995
JP 2003-074789 A1 3/2003

* cited by examiner

*Primary Examiner* — Dana Ross
*Assistant Examiner* — Renee L Miller
(74) *Attorney, Agent, or Firm* — Burr & Brown, PLLC

(57) ABSTRACT

There is disclosed a heater which does not excessively heat a lubricating fluid but can rapidly raise a temperature of the lubricating fluid, even when a size thereof is small. A heater includes a honeycomb structure section including partition walls which contain a ceramic as a main component and generate heat by electrical conduction, and a plurality of cells which are partitioned and formed by the partition walls and extend through the honeycomb structure section from one end to another end to become through channels of a lubricating fluid; and a pair of electrodes which become an anode and a cathode to come in contact with the honeycomb structure section, thereby conducting the electricity through the partition walls of the honeycomb structure section.

13 Claims, 12 Drawing Sheets

HEATER

BACKGROUND OF THE INVENTION

1. Field of the Invention

The present invention relates to a heater which can be used to heat a lubricating fluid such as an engine oil or a transmission fluid.

2. Description of Related Art

Some machines operate, while rubbing parts against each other. For example, in an internal combustion engine such as an internal engine, a large number of parts rub against one another in a process of the up-and-down movement of a piston in a cylinder. When the parts rub against one another in this manner, wear or heat generation occurs on the parts, and defects are generated in the machines. Therefore, a lubricating fluid is used to decrease friction when the parts rub against one another, thereby suppressing the wear and the heat generation. For example, an engine oil is used as the lubricating fluid to suppress the wear and the heat generation on the parts in the engine. The lubricating fluid is indispensable in suitably operating the machine in this manner. However, when the lubricating fluid is in a low-temperature state, a viscosity of the lubricating fluid becomes high. In consequence, a problem occurs that friction cannot sufficiently be lowered. There occurs another problem that the lubricating fluid cannot be supplied to a targeted portion, or the like. To cope with this problem, the lubricating fluid is heated by using a heater to raise the temperature of the lubricating fluid, thereby appropriately lowering the viscosity thereof. When the heater is used in this manner, it is possible to lower the viscosity of the lubricating fluid. On the other hand, a disadvantage occurs that when the lubricating fluid is excessively heated by the heater, the deterioration of the lubricating fluid is caused. Consequently, there has been disclosed a heater including a mechanism which does not excessively heat the lubricating fluid (e.g., Patent Documents 1 to 3).

[Patent Document 1] JP-A-2003-74789
[Patent Document 2] JP-A-63-16114
[Patent Document 3] JU-A-63-12607

SUMMARY OF THE INVENTION

In the above conventional heaters, however, it has been difficult to rapidly raise a temperature of a lubricating fluid, while leaving, in an effective state, a mechanism which does not excessively heat the lubricating fluid. For example, Patent Document 1 discloses a freezing preventive structure which indirectly heats a lubricant oil by a heater placed in a shell, to prevent the deterioration of the lubricant oil. According to the invention disclosed in Patent Document 1, the heater is placed in the shell, and hence it is considered to be difficult to rapidly raise the temperature. Moreover, Patent Documents 2 and 3 disclose a heating device (an oil heater) of an engine oil, where a heat release member and a fin, which do not generate heat by themselves, are attached to the heater to enlarge a heat transfer area (a heat exchange area). In the inventions disclosed in Patent Documents 2 and 3, the heat release member and the fin do not generate any heat, and hence it is considered to be difficult to rapidly raise the temperature. Nonetheless, for achieving a purpose of "rapidly raising the temperature of the lubricating fluid while leaving, in the effective state, the mechanism which does not excessively heat the lubricating fluid", a size of the heater has to be enlarged. However, there have been strict spatial restrictions on the interiors of automobiles, and hence it has been strongly demanded that the heaters are miniaturized.

The present invention has been developed in view of the above problems, and an object thereof is to provide a heater which does not excessively heat a lubricating fluid, but can rapidly raise a temperature of the lubricating fluid, even when a size of the heater is small.

Means for Solving the Problem

The present invention achieves the above object. Specifically, the present invention is a heater described hereinafter.

[1] A heater comprising: a honeycomb structure section including partition walls which contain a ceramic as a main component and generate heat by electrical conduction, and a plurality of cells which are partitioned and formed by the partition walls and extend through the honeycomb structure section from one end thereof to the other end to become through channels of a lubricating fluid; and a pair of electrodes which become an anode and a cathode to come in contact with the honeycomb structure section, thereby conducting the electricity through the partition walls of the honeycomb structure section.

[2] The heater according to the above [1], wherein in the honeycomb structure section, thicknesses of the partition walls are from 0.10 to 0.51 mm, and a cell density is from 15 to 280 cells/$cm^2$.

[3] The heater according to the above [1] or [2], wherein in the honeycomb structure section, specific electrical resistances of the partition walls are from 0.01 to 50 Ω·cm.

[4] The heater according to any one of the above [1] to [3], wherein the partition walls contain, as the main component, one selected from the group consisting of SiC, metal-impregnated SiC, metal-bonded SiC, and metal-bonded $Si_3N_4$.

[5] The heater according to any one of the above [1] to [4], which does not include partition walls orthogonal to a direction from the one electrode to the other electrode, in a cross section orthogonal to an extending direction of the cells.

[6] The heater according to any one of the above [1] to [5], wherein the surfaces of the partition walls include an insulating layer having a dielectric breakdown strength of 10 to 1000 V/μm.

Effect of the Invention

A heater of the present invention does not excessively heat a lubricating fluid, but can rapidly raise a temperature of the lubricating fluid, even when a size of the heater is small.

DETAILED DESCRIPTION OF THE INVENTION

Figure 1:
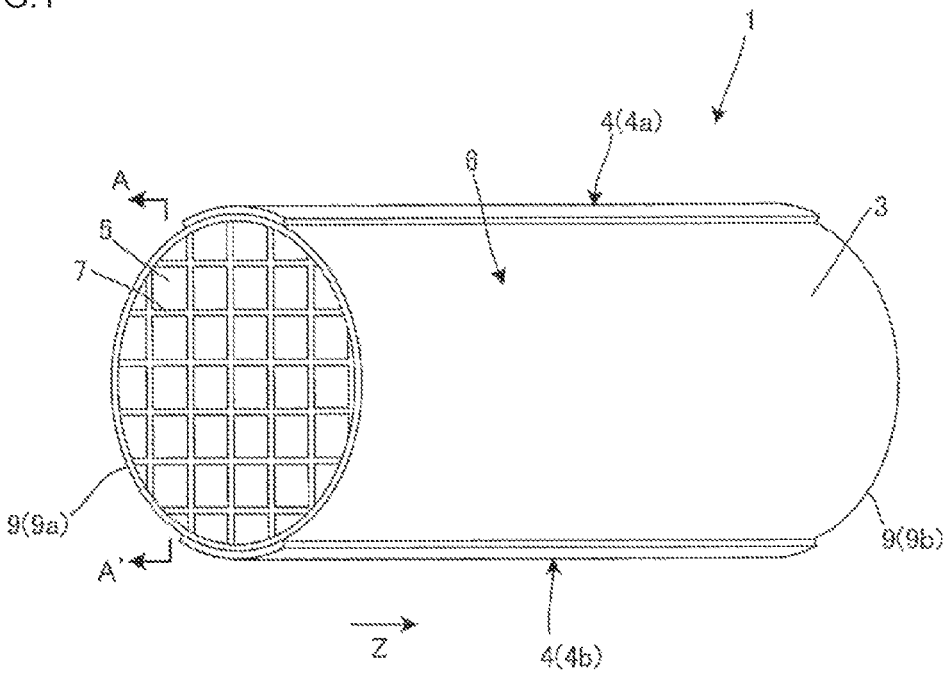
FIG. 1 is a perspective view showing an embodiment of a heater of the present invention.

Hereinafter, embodiments of the present invention will be described with reference to the drawings. The present invention is not limited to the following embodiments, and changes, modifications and improvements can be added without departing from the scope of the present invention.

A heater of the present invention includes a honeycomb structure section including "partition walls which contain a ceramic as a main component and generate heat by electrical conduction", and "a plurality of cells which are partitioned and formed by the partition walls and extend through the honeycomb structure section from one end thereof to the other end to become through channels of a lubricating fluid"; and a pair of electrodes which become an anode and a cathode to come in contact with the honeycomb structure section, thereby conducting the electricity through the partition walls of the honeycomb structure section. The honeycomb structure section includes the partition walls to partition and form "the plurality of cells which extend from one end (end surface) to the other end (end surface)".

In the heater of the present invention, the partition walls themselves generate the heat by the electrical conduction. Therefore, when the lubricating fluid flows through the cells from the one end (an inflow end) to the other end (an outflow end), the partition walls can continuously heat the lubricating fluid. When the partition walls themselves do not generate any heat, the partition walls are cooled by the lubricating fluid. Therefore, when the lubricating fluid reaches the vicinity of the other end (the outflow end), the partition walls cannot heat the lubricating fluid sometimes. Such a phenomenon does not easily occur in the heater of the present invention. Thus, according to the heater of the present invention, the increase of a contact area can be realized by a honeycomb structure. Therefore, the heater of the present invention can constantly heat the lubricating fluid flowing through the cells. In consequence, the heater of the present invention can rapidly raise a temperature of the lubricating fluid.

Moreover, the heater of the present invention can continuously heat the lubricating fluid in the cells as described above. Therefore, the heater of the present invention can securely raise the temperature of the lubricating fluid, even when an amount of the heat to be generated per unit area of the partition walls is decreased. When the amount of the heat to be generated per unit area of the partition walls is decreased in this manner, it is possible to prevent the lubricating fluid from being excessively heated. Therefore, the heater of the present invention does not excessively heat the oil, but can rapidly raise the temperature of the lubricating fluid. Moreover, the heater of the present invention does not excessively heat the lubricating fluid as described above. Therefore, when the heater of the present invention is used, the deterioration of the lubricating fluid can be suppressed.

Furthermore, in the heater of the present invention, the lubricating fluid is distributed into the plurality of cells to flow therethrough. That is, the lubricating fluid is divided, and the divided lubricating fluids flow through the cells, respectively. When the lubricating fluid is divided to flow in this manner, the contact area between the lubricating fluid and the partition walls becomes large. Thus, an amount of the heat to be conducted by the contact between the partition walls and the lubricating fluid also increases. When the amount of the heat to be conducted by the contact with the partition walls increases and the lubricating fluid flows through the cells, the amount of the heat to be conducted from the partition walls to the lubricating fluid becomes larger than an amount of the heat to be dissipated by thermal diffusion in the lubricating fluid. Therefore, the temperature of the lubricating fluid easily rapidly rises. Moreover, in the heater of the present invention, the contact area between the lubricating fluid and the partition walls is large as described above. Therefore, even when the amount of the heat to be generated per unit area of the partition walls is decreased, it is possible to securely raise the temperature of the lubricating fluid. In consequence, it is possible to prevent the lubricating fluid from being excessively heated.

Moreover, even when a size of the heater of the present invention is small, a cell density is increased so that the contact area between the lubricating fluid and the partition walls can be increased. In consequence, it is possible to rapidly raise the temperature of the lubricating fluid. Moreover, the cell density is increased so that the contact area between the lubricating fluid and the partition walls becomes sufficiently large. In this case, even when a length of each of the cells is shortened, it is possible to sufficiently heat the lubricating fluid. When the length of the cell is shortened, it is meant that the size of the heater is decreased. Therefore, even when the size is small, the cell density is increased to enlarge the contact area between the lubricating fluid and the partition walls. In this case, even when the lubricating fluid is heated even in a mode where the amount of the heat to be generated per unit area of the partition walls is decreased, it is possible to rapidly raise the temperature of the lubricating fluid. In consequence, even when the heater of the present invention has a small size, the lubricating fluid is not excessively heated, but the temperature of the lubricating fluid can rapidly be raised.

The lubricating fluid mentioned in the present description means a generic term of fluids such as an engine oil, a transmission fluid, a gear oil, a differential oil, a brake fluid and a power steering fluid, for use in lubricating mechanical parts.

In the heater of the present invention, the honeycomb structure section preferably has a partition wall thickness of 0.1 to 0.51 mm, and a cell density of 15 to 280 cells/cm$^2$. When the partition wall thickness and cell density of the honeycomb structure section are in the above ranges, it is possible to enhance an effect that the lubricating fluid is not excessively heated but the temperature of the lubricating fluid can rapidly be raised. Furthermore, the honeycomb structure section more preferably has "a partition wall thickness of 0.25 to 0.51 mm, and a cell density of 15 to 62 cells/cm$^2$", and further preferably has "a partition wall thickness of 0.30 to 0.38 mm, and a cell density of 23 to 54 cells/cm$^2$". This is because it is possible to decrease a pressure loss when the lubricating fluid flows through the honeycomb structure section.

Here, when a ceramic is contained as a main component as mentioned in the present description, it is meant that 50 mass % or more ceramic is contained. That is, the partition walls containing the ceramic as the main component mean the partition walls containing 50 mass % or more ceramic. Moreover, examples of "the ceramic which generates the heat by electrical conduction" applicable to the present invention can include SiC, metal-impregnated SiC, metal-bonded SiC, and metal-bonded $Si_3N_4$.

SiC includes recrystallized SiC and reaction-sintered SiC. The recrystallized SiC is prepared, for example, as follows. First, a raw material containing SiC powder, an organic binder and "water or an organic solvent" is mixed and kneaded to prepare a kneaded material. Next, this kneaded material is formed to prepare a formed body. Next, the obtained formed body is sintered at 1600 to 2300° C. in an inert gas atmosphere, to obtain a sintered body. The "recrystallized SiC" is obtained in this manner. Then, the obtained sintered body mainly becomes porous. A specific electrical resistance of the recrystallized SiC can be changed by changing the raw material, particle diameters, an amount of impurities, or the like. For example, when the impurities are dissolved in SiC, the specific electrical resistance can be changed. Specifically, when the body is sintered in a nitrogen atmosphere, nitrogen is dissolved in SiC so that the specific electrical resistance of recrystallized SiC can be decreased.

The reaction-sintered SiC is SiC produced by utilizing a reaction between the raw materials. Examples of the reaction-sintered SiC can include porous reaction-sintered SiC and dense reaction-sintered SiC. The porous reaction-sintered SiC is prepared, for example, as follows. First, silicon nitride powder, a carbonaceous material, silicon carbide and graphite powder are mixed and kneaded to prepare a kneaded material. It is to be noted that the carbonaceous material is a material which reduces silicon nitride. Examples of the carbonaceous material can include solid carbon powder such as carbon black and acetylene black, and resins such as phenol, furan and polyimide. Next, this kneaded material is formed to prepare a formed body. Next, the formed body is primarily sintered in a non-oxidation atmosphere, to obtain a primary sintered body. Next, the obtained primary sintered body is heated and decarburized in an oxidation atmosphere, to remove residual graphite. Next, "the decarburized primary sintered body" is secondarily sintered at 1600 to 2500° C. in the non-oxidation atmosphere, to obtain a secondary sintered body. The "porous reaction-sintered SiC" is obtained in this manner.

The dense reaction-sintered SIC is prepared, for example, as follows. First, SiC powder and graphite powder are mixed and kneaded to prepare a kneaded material. Next, this kneaded material is formed to prepare a formed body. Next, this formed body is impregnated with "molten silicon (Si)". In consequence, carbon constituting graphite is reacted with impregnated silicon to produce SiC. As described above, the formed body is "impregnated" with "molten silicon (Si)", whereby pores easily disappear. That is, the pores are easily clogged. Therefore, it is possible to obtain a dense body. The "dense reaction-sintered SiC" is obtained in this manner.

Moreover, examples of metal-impregnated SiC as "the ceramic which generates the heat by the electrical conduction" applicable to the present invention can include Si-impregnated SiC, and "SiC impregnated with metal Si and "another type of metal"". Examples of "the other type of metal" can include Al, Cu, Ag, Be, Mg, Ti and Ni. In the heater of the present invention, when the partition walls contain, as the main component, "Si-impregnated SiC" or "SiC impregnated with metal Si and the other type of metal", the partition walls become excellent in thermal resistance, thermal shock resistance, oxidation resistance, and corrosion resistance to acids, alkalis and the like. In the present description, "Si-impregnated SiC" is a generic term of a sintered body containing metal Si and SiC as constitutional components. In particular, in metal-impregnated SiC, a porous material containing SiC particles as the main component is impregnated with a molten metal, and hence the SiC has characteristics that a dense body including comparatively less pores can be obtained. This Si-impregnated SiC has a structure where the surfaces of the SiC particles are surrounded with a condensate of metal silicon (metal Si), and the SiC particles bond with one another via metal Si. Moreover, in the present description, "SiC impregnated with metal Si and the other type of metal" is a generic term of a sintered body containing metal Si, the other type of metal and SiC as constitutional components. The "SiC impregnated with metal Si and the other type of metal" has a structure where the surfaces of the SiC particles are surrounded with a condensate of metal silicon (metal Si) or the other type of metal, and the SiC particles bond with one another via "metal Si or the other type of metal".

Furthermore, examples of metal-bonded SiC as "the ceramic which generates the heat by the electrical conduction" applicable to the present invention can include "Si-bonded SiC" and "combined sintering SiC of metal Si and "the other type of metal"". Examples of "the other type of metal" can include Al, Cu, Ag, Be, Mg, Ti and Ni. Hereinafter, "combined sintering SiC of metal Si and "the other type of metal"" will be referred to as "combined sintering SiC". Here, metal-bonded SiC is obtained by mixing and sintering the SiC particles and metal powder. In a method of mixing and sintering the SiC particles and the metal powder, the sintering proceeds at a contact point where the SiC particles come in contact with the metal powder, and hence there are characteristics that a porous body including a comparatively large number of pores can be obtained. Moreover, the metal-bonded SiC takes a structure where the SiC particles are interconnected via a metal phase, while the pores are interposed. For example, Si-bonded SiC has a structure where the surfaces of the SiC particles bond with a metal silicon (metal Si) phase, and the SiC particles bond with one another via metal Si, while forming the pores. Moreover, "combined sintering SiC" has a structure where the surfaces of the SiC particles bond with a phase formed by "metal Si and "the other type of metal"", and the SiC particles bond with one another via "metal Si and "the other type of metal"", while forming the pores.

When the partition walls contain the metal-impregnated SiC or metal-bonded SiC as a main component, an amount or type of the metal to be impregnated or bonded is adjusted, whereby the specific electrical resistance of the partition walls can be increased or decreased. When the partition walls contain the metal-impregnated SiC or the metal-bonded SiC as the main component, the specific electrical resistance of the partition walls usually becomes smaller as the amount of the metal to be impregnated or bonded.

Moreover, in the heater of the present invention, when a porosity of the partition walls is regulated, it is possible to increase or decrease the specific electrical resistance of the partition walls. In general, the smaller the porosity of the partition walls is, the smaller the specific electrical resistance becomes. In consequence, electricity easily flows through the partition walls.

Moreover, a preferable range of the porosity of the partition walls varies in accordance with the main component of the partition walls. When the main component is, for example, the metal-bonded SiC, the porosity of the partition walls is preferably from 30 to 90%. Moreover, when the metal-bonded SiC is the main component, a large number of open pores are present in the partition walls, and the pores become large. Further in the partition walls containing the metal-bonded SiC as the main component, a large number of continuous pores which connect between the adjacent cells are present. Therefore, the lubricating fluid can pass through the partition walls owing to the continuous pores. Therefore, the contact area between the partition walls and the lubricating fluid becomes large. Consequently, a heating efficiency (i.e., a heat exchange efficiency) enhances in the heater including the honeycomb structure section including the partition walls containing the metal-bonded SiC as the main component. On the other hand, when, for example, the metal-impregnated SiC is the main component, the porosity of the partition walls is preferably from 0 to 10%. Moreover, when the metal-impregnated SiC is the main component, the pores of the partition walls become small, and the open pores decrease. Therefore, the lubricating fluid does not easily penetrate into the partition walls containing the metal-impregnated SiC as the main component. Consequently, the lubricating fluid which remains in the pores of the partition walls and does not flow through the pores decreases. Therefore, it is possible to prevent the lubricating fluid from being overheated and deteriorated. Moreover, there are not any pores connecting between the cells, and hence the lubricating fluid does not pass through the partition walls. Therefore, the lubricating fluid can flow only through the cells.

Further in the heater of the present invention, the specific electrical resistance of the partition walls can be adjusted in accordance with a type of SiC (α-SiC and β-SiC) for use as the raw material.

A size of the specific electrical resistance of the partition walls can be changed also in accordance with the amount of the impurities in the metal for use as the raw material. Moreover, also when an alloyed material is used as the metal or the metal is alloyed during manufacturing, the specific electrical resistance of the partition walls can be changed.

Moreover, in the heater of the present invention, the amount of the heat to be generated per unit surface area of the partition walls depends on a size of the honeycomb structure section, the specific electrical resistance of each of the partition walls, the thickness of each partition wall, and the cell density. Therefore, in the heater of the present invention, when the size of the honeycomb structure section is predetermined in accordance with a breadth of a space where the heater is disposed, the thickness of the partition wall, the cell density or the specific electrical resistance of the partition wall is regulated, so that the amount of the heat to be generated per unit surface area of the partition walls can suitably be suppressed. In consequence, the lubricating fluid can be prevented from being excessively heated. The "size of the honeycomb structure section" is a length or a width of the honeycomb structure section.

Usually in the heater of the present invention, when the length of the honeycomb structure section (the lengths of the cells) is increased, the lubricating fluid can sufficiently be heated even in a case where the specific electrical resistances of the partition walls are decreased. In consequence, it is possible to rapidly raise the temperature of the lubricating fluid. Moreover, even when the length of the honeycomb structure section (the lengths of the cells) is small, the number of the cells is increased (e.g., the cell density is increased), the lubricating fluid can sufficiently be heated. Consequently, it is possible to rapidly raise the temperature of the lubricating fluid. In the heater of the present invention, the specific electrical resistances of the partition walls are preferably from 0.01 to 50 Ω·cm. The specific electrical resistances of the partition walls are further preferably from 0.03 to 10 Ω·cm, and especially preferably from 0.07 to 5 Ω·cm. This is because the honeycomb structure section can be miniaturized while keeping a state where the lubricating fluid can sufficiently be heated.

The heater of the present invention preferably includes the honeycomb structure section including the partition walls which contain the ceramic as the main component and generate the heat by the electrical conduction, and the plurality of cells which are partitioned and formed by the partition walls and extend through the honeycomb structure section from one end thereof to the other end to become through channels of oil; and the pair of electrodes which become the anode and the cathode to come in contact with the honeycomb structure section, thereby conducting the electricity through the partition walls of the honeycomb structure section. The surfaces of the partition walls preferably include an insulating layer having a dielectric breakdown strength of 10 to 1000 V/μm. The dielectric breakdown strength is further preferably from 100 to 1000 V/μm. The lubricating fluid includes metallic abrasion powder, a water content or the like generated from mechanical parts sometimes. In particular, a large part of the metallic abrasion powder can be removed by an oil filter or the like, but some of the powder is not removed and remains in the lubricating fluid. Therefore, when the heater is used for a long period of time, the metallic abrasion powder which is not removed but remains sticks to the partition walls, or is deposited to clog the pores sometimes. In such a case, there is a possibility that the heater short-circuits. When the surfaces of the partition walls of the honeycomb structure section include the insulating layer having a dielectric breakdown strength of 10 to 1000 V/μm, it is possible to prevent the short circuit of the heater due to the clogging caused by the metallic abrasion powder included in the lubricating fluid which sticks to or is deposited on the partition walls.

Examples of the insulating layer can include an oxide film prepared by oxidizing the ceramic component included in the partition walls. Such an oxide film can be formed by carrying out a high-temperature treatment in an oxidation atmosphere.

Alternatively, the surfaces of the partition walls are coated with an insulating resin, whereby it is possible to provide the insulating layer. In the heater of the present invention, when the insulating layer on the surfaces of the partition walls are made of an insulating resin, a usually used resin such as EPDM, an ethylene propylene copolymer, polyimide or polyamide imide can be used as the insulating resin.

As the insulating layer, a layer constituted of a ceramic coating layer, an $SiO_2$ glass coating layer or a coating layer of a mixture of the ceramic and "$SiO_2$ glass" can be provided.

Examples of the ceramic coating layer can include a layer containing an oxide such as $Al_2O_3$, MgO, $ZrO_2$, $TiO_2$ or $CeO_2$ as a main component, and a layer containing a nitride as the main component. In the layer containing the oxide as the main component and the layer containing the nitride as the main component, the layer containing the oxide as the main component has a higher stability in the atmospheric air. On the other hand, the layer containing the nitride as the main component is more excellent in thermal conductivity. Examples of the $SiO_2$ glass coating layer can include a layer containing $SiO_2$ as the main component. Examples of the coating layer of the mixture of the ceramic and the $SiO_2$ glass can include a layer containing the mixture of $SiO_2$ and "a component such as $Al_2O_3$, MgO, $ZrO_2$, $TiO_2$ or $CeO_2$". It is to be noted that the constitutional components of the insulating layer can suitably be selected in accordance with a desired value of a withstand voltage.

When the ceramic coating layer, the $SiO_2$ glass coating layer and the coating layer of the mixture of the ceramic and $SiO_2$ glass are formed, a method by a wet system or a method by a dry system can be employed.

The method by the wet system can include a method of immersing a honeycomb sintered body into one of an insulating layer forming slurry, an insulating layer forming colloid and an insulating layer forming solution, and then removing a surplus, followed by drying and sintering.

For example, when "the insulating layer containing the oxide as the main component" is formed, a material containing a metal source of Al, Mg, Si, Zr, Ti, Ce or the like or the oxide thereof can be used as the insulating layer forming slurry and the insulating layer forming colloid. "The insulating layer containing the oxide as the main component" is an insulating layer containing $Al_2O_3$, MgO, $SiO_2$, $ZrO_2$, $TiO_2$, $CeO_2$ or the like as the main component. As the insulating layer forming solution, a metal alcoxide solution such as $Al(OC_3H_7)_3$ or $Si(OC_2H_5)_4$ can be used. A sintering temperature in the wet type method can suitably be determined in accordance with the main component. The sintering temperature in the wet type method is preferably from 1100 to 1200° C. for the insulating layer containing, for example, $SiO_2$ as the main component. Moreover, for the insulating layer containing $Al_2O_3$ as the main component, the temperature is preferably from 1300 to 1400° C.

When "the insulating layer containing the nitride as the main component" is formed, a honeycomb formed body is immersed into one of the insulating layer forming slurry, the insulating layer forming colloid and the insulating layer forming solution, and then removing the surplus, followed by drying. Afterward, the nitride is formed in a reducing atmosphere containing nitrogen or ammonia. Thus, the insulating layer containing the nitride as the main component can be formed. Examples of the nitride can include AlN and $Si_3N_4$ having insulating properties but having a high thermal conductivity.

Examples of the dry type method can include an electrostatic spraying process. The insulating layer is formed by the electrostatic spraying process, for example, as follows. First, a voltage is applied to powder of an insulating material (insulating particles) or "a slurry containing the insulating particles", to negatively (or positively) electrify this material. Afterward, the electrified "insulating particles or slurry containing the insulating particles" are sprayed on the positively (or negatively) electrified honeycomb structure section. The insulating layer is formed in this manner.

A film thickness of the insulating layer can suitably be set in accordance with a desired withstand voltage. When the film thickness of the insulating layer is large, the insulating properties become high. However, a thermal resistance becomes large undesirably for heating the lubricating fluid. This is because the thermal conductivity of the insulating layer easily lowers as compared with the partition walls. Furthermore, a pressure loss of the heater becomes large. Therefore, the film thickness of the insulating layer is preferably small in such a range that the insulating properties can be acquired. Specifically, the film thickness of the insulating layer is preferably smaller than that of each partition wall. Further specifically, the film thickness depends on the dielectric breakdown strength of each material, but is preferably 10 μm or smaller, further preferably 5 μm or smaller, and especially preferably 3 μm or smaller. When the film thickness of the insulating layer is in the above range, it is possible to prevent the increase of the pressure loss of the honeycomb structure section, while maintaining a low thermal resistance. The film thickness of the insulating layer means an average film thickness of the insulating layer. The film thickness of the insulating layer is a value measured by observing a sample of a cross section with an optical microscope (OM) or a scanning electron microscope (SEM). Here, "the cross section sample" is a sample of cut-out part of the heater, and the sample has a cut cross section orthogonal to the wall surfaces of the partition walls. Moreover, when the insulating layer is an oxide film and the oxide film having the above thickness is formed, a sintering temperature is preferably from 1200 to 1400° C. Moreover, a sintering method in a water vapor atmosphere to form the oxide film is also a preferable method. Furthermore, when a sintering time is regulated, the film thickness of the oxide film can be regulated. The longer the sintering time is, the larger the thickness of the oxide film becomes.

The heater of the present invention can be used to heat, for example, an engine oil and a transmission fluid of an automobile. In general, when the automobile is driven in winter or a cold district, the engine oil and the transmission fluid easily have a low temperature, and viscosities thereof become high often. Consequently, a time when an engine and a transmission operate, while keeping a state where a friction generated in the mechanical parts is large, lengthens. When the engine and the transmission operate in such a state, the deterioration of a fuel efficiency occurs. When the heater of the present invention is used, it is possible to rapidly raise the temperature of the engine oil and the transmission fluid. Therefore, it is possible to shorten a time when the engine oil and the transmission fluid have the low temperature. In consequence, the fuel efficiency can enhance. Moreover, the transmission fluid usually contributes to the deterioration of the fuel efficiency more than the engine oil. Therefore, a conventional technology has to use a large-sized heater for sufficiently heating the transmission fluid. According to the heater of the present invention, even when the heater is made small, it is possible to sufficiently heat the transmission fluid. Therefore, the fuel efficiency can enhance. That is, when the heater of the present invention is used in a case where a breadth of a space for installing the heater is limited as in the automobile, the effect of the heater can sufficiently be exerted.

Hereinafter, contents of specific embodiments of the heater of the present invention will be described in detail.

FIG. 1 is a perspective view of an embodiment of the heater of the present invention. A heater 1 of the present embodiment includes a honeycomb structure section 6, and a pair of electrodes 4 joined to an outer peripheral wall 3 of the honeycomb structure section 6. The honeycomb structure section 6 includes the cylindrical outer peripheral wall 3 which open at both of one end 9*a* and another end 9*b*. In the honeycomb structure section 6, the cylinder interior of the outer peripheral wall 3 is partitioned by partition walls 7. Specifically, when the honeycomb structure section 6 is seen from a cross section perpendicular to an extending direction of the outer peripheral wall 3 (a direction connecting the end 9*a* to the end 9*b*: Z-direction), the interior surrounded with the outer peripheral wall 3 is quadrangularly partitioned, as in squares of a graph paper, by the mutually orthogonal partition walls 7. In consequence, cells 5 are formed in inner partitioned portions of the outer peripheral wall 3. It is to be noted that in the heater 1 of the present embodiment, the sectional shape of the outer peripheral wall 3 of the honeycomb structure section 6 (a shape of the cross section perpendicular to a cell extending direction) is circular. In addition to the circular shape, however, an elliptic shape, a quadrangular shape or the like may be formed. Also as to the sectional shape of each of the cells 5, an optional shape such as a hexagonal shape or a circular shape can be applied in addition to the quadrangular shape.

According to the heater 1 of the present embodiment, in the honeycomb structure section 6, the outer peripheral wall 3 and the partition walls 7 preferably contain Si-bonded SiC, Si-impregnated SiC, recrystallized SiC or reaction-sintered SiC as a main component. Further in the honeycomb structure section 6, specific electrical resistances of the outer peripheral wall 3 and the partition walls 7 are preferably from 0.01 to 50 Ω·cm. When the honeycomb structure section 6 containing Si-bonded SiC as the main component is prepared, first, SiC powder, metal Si powder, water, an organic binder and the like are mixed and kneaded to prepare a kneaded material. Then, this kneaded material is formed in a honeycomb shape to prepare a honeycomb formed body. Afterward, the obtained honeycomb formed body is sintered in an inert gas atmosphere, whereby the honeycomb structure section containing Si-impregnated SiC as the main component can be manufactured. Moreover, when the honeycomb structure section 6 containing Si-impregnated SiC as the main component is prepared, first, "SiC powder, metal Si powder, water, the organic binder and the like" are mixed and kneaded to prepare a kneaded material, or "SiC powder, water, the organic binder and the like" are mixed and kneaded to prepare the kneaded material. Then, this kneaded material is formed in a honeycomb shape to prepare the honeycomb formed body. Afterward, the obtained honeycomb formed body is sintered in the inert gas atmosphere, to form a honeycomb structure. Afterward, the obtained honeycomb structure is impregnated with Si in the inert gas atmosphere, whereby the honeycomb structure section 6 containing Si-impregnated SiC as the main component can be manufactured. It is to be noted that recrystallized SiC and reaction-sintered SiC are prepared as described above. Moreover, examples of a material constituting the outer peripheral wall 3 and the partition walls 7 and having a specific electrical resistance of 0.01 to 50 Ω·cm can include silicon carbide, Fe-16Cr-8Al, $SrTiO_3$ (perovskite), $Fe_2O_3$ (corundum), $SnO_3$ (rutile), and ZnO (wurtzite). The specific electrical resistance of silicon carbide is usually in a wide range of 1 to 1000 Ω·cm. When SiC is used alone, the above-mentioned specific electrical resistance range is preferable. When Si and Si-based alloy are bonded, a specific electrical resistance of 1000 Ω·cm at maximum can be applied, depending on a microstructure. A specific electrical resistance of Fe-16Cr-8Al is 0.03 Ω·cm. A specific electrical resistance of $SrTiO_3$ (perovskite) is 0.1 Ω·cm or smaller. A specific electrical resistance of $Fe_2O_3$ (corundum) is about 10 Ω·cm. A specific electrical resistance of $SnO_3$ (rutile) is 0.1 Ω·cm or smaller. A specific electrical resistance of ZnO (wurtzite) is 0.1 Ω·cm or smaller.

Here, in the honeycomb structure section 6, a value of a content of metal Si/(the content of Si+a content of SiC) is preferably from 5 to 50. Furthermore, the value of the content of metal Si/(the content of Si+the content of SiC) is further preferably from 10 to 40. This is because the specific electrical resistance can be a suitable size, while keeping strengths of the outer peripheral wall 3 and the partition walls 7.

The outer peripheral wall 3 of the honeycomb structure section 6 is further preferably thick. When the outer peripheral wall 3 is thick, it is meant that the outer peripheral wall 3 is thicker than the partition walls 7. When the outer peripheral wall 3 is thick, a structural strength of the outer peripheral wall 3 increases. Therefore, a resistance to thermal stress when joining the electrodes can enhance. In consequence, the generation of cracks in the outer peripheral wall 3, or the like is easily suppressed. Moreover, when the outer peripheral wall 3 is thick, a heat capacity of the outer peripheral wall 3 increases. Therefore, a temperature rise of the outer peripheral wall 3 at the time of electrical conduction can be decreased. Here, the outer peripheral wall 3 is easily overheated, because a contact area thereof with a lubricating fluid such as the engine oil is small. Therefore, the temperature rise of the outer peripheral wall 3 at the time of the electrical conduction is preferably decreased as described above. Moreover, when a resin is used in at least a part of a housing of the heater, the heater is locally overheated, whereby the resin is deteriorated and damaged sometimes. Therefore, when the outer peripheral wall 3 of the honeycomb structure section is thickened, it is possible to suppress the damages due to the deterioration of the resin.

The thickness of the outer peripheral wall 3 is preferably from 0.3 to 5 mm, and further preferably from 0.5 to 3 mm, depending on a porosity of the outer peripheral wall 3, or the like.

Moreover, the outer peripheral wall 3 of the honeycomb structure section 6 is further preferably dense. When the outer peripheral wall 3 is dense, it is possible to prevent the lubricating fluid from leaking to the outside of the heater through the outer peripheral wall 3. Here, when the heater is placed in the housing, an outer periphery of the heater is usually provided with a sealing material to prevent the lubricating fluid from leaking into the housing. When the outer peripheral wall 3 is dense, the lubricating fluid can be prevented from leaking to the outside of the heater. Therefore, the above-mentioned sealing material is not required.

The "dense outer peripheral wall 3" is preferably impregnated with, for example, a metal, and thus densified. Moreover, "the dense outer peripheral wall 3" may be made of dense "$Al_2O_3$, MgO, $SiO_2$, $Si_3N_4$, AlN or BN" or a composite thereof.

Such a honeycomb structure section including "the dense outer peripheral wall 3" can be prepared by co-extruding, for example, "a material constituting the partition walls 7" and "a material constituting the outer peripheral wall 3" which is different from "the material constituting the partition walls 7".

Moreover, the honeycomb structure section including "the outer peripheral wall 3 densified by impregnating the wall with the metal" is preferably formed by impregnating a dried honeycomb formed body or a sintered honeycomb body with the metal. Furthermore, for impregnating the dried honeycomb formed body or the sintered honeycomb body with the metal, there is a method of regulating an amount of Si to be impregnated so that the only outer peripheral wall is impregnated. Moreover, there is a method of coating both end surfaces of the dried honeycomb formed body or the sintered honeycomb body with a impregnation inhibitor, or mounting a plate-like jig on both the above end surfaces. According to this method, the outer peripheral wall can preferentially be impregnated with the metal. Examples of the impregnation inhibitor can include an oxide inhibitor, and especially $Al_2O_3$.

Furthermore, in the heater 1 of the present embodiment, SiC is oxidized to produce $SiO_2$, thereby forming an oxide film on the surfaces of the partition walls 7. When the oxide film is formed on the surfaces of the partition walls 7, a high-temperature treatment is carried out in an oxidation atmosphere such as the atmospheric air. When the main component of the partition walls is SiC, Si-impregnated SiC or Si-bonded SiC as in the honeycomb structure section 6 of the heater 1 of the present embodiment, a heat treatment is carried out, for example, at 1200 to 1400° C. in the atmospheric air, whereby the oxide film can be formed on the surfaces of the partition walls 7.

Furthermore, in the heater 1 of the present embodiment, the outer peripheral wall 3 of the honeycomb structure section 6 is joined to the pair of electrodes 4 (an anode 4*a* and a cathode 4*b*). In the heater 1 of the present embodiment, the honeycomb structure section 6 is laterally sandwiched between the anode 4*a* and the cathode 4*b*. Therefore, when the electricity is conducted through the honeycomb structure section 6, the partition walls 7 can generate heat. A shape of the pair of electrodes 4 can be a rectangular shape, a rod-like shape or the like.

Figure 2:
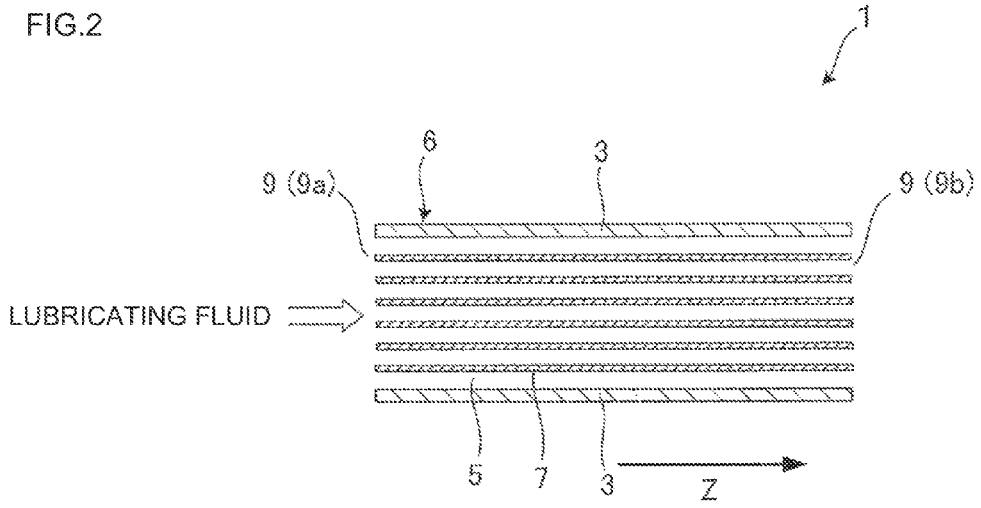
FIG. 2 is a schematic view showing a cross section cut along the A-A' line of FIG. 1.

FIG. 2 is a sectional view showing a cross section cut along the A-A' line of FIG. 1. As shown in FIG. 2, the plurality of cells 5 extend through the interior surrounded with the outer peripheral wall 3 from the end 9*a* to the end 9*b*. Here, when the lubricating fluid flows through the heater 1 from the end 9*a* of the honeycomb structure section 6, the lubricating fluid is distributed to the plurality of cells 5, to flow through the cells 5. At this time, when the electricity is conducted through the honeycomb structure section 6, the partition walls 7 to partition the cells 5 can generate the heat. In consequence, when the lubricating fluid passes through the cells 5, the lubricating fluid can continuously be heated.

Figure 3:
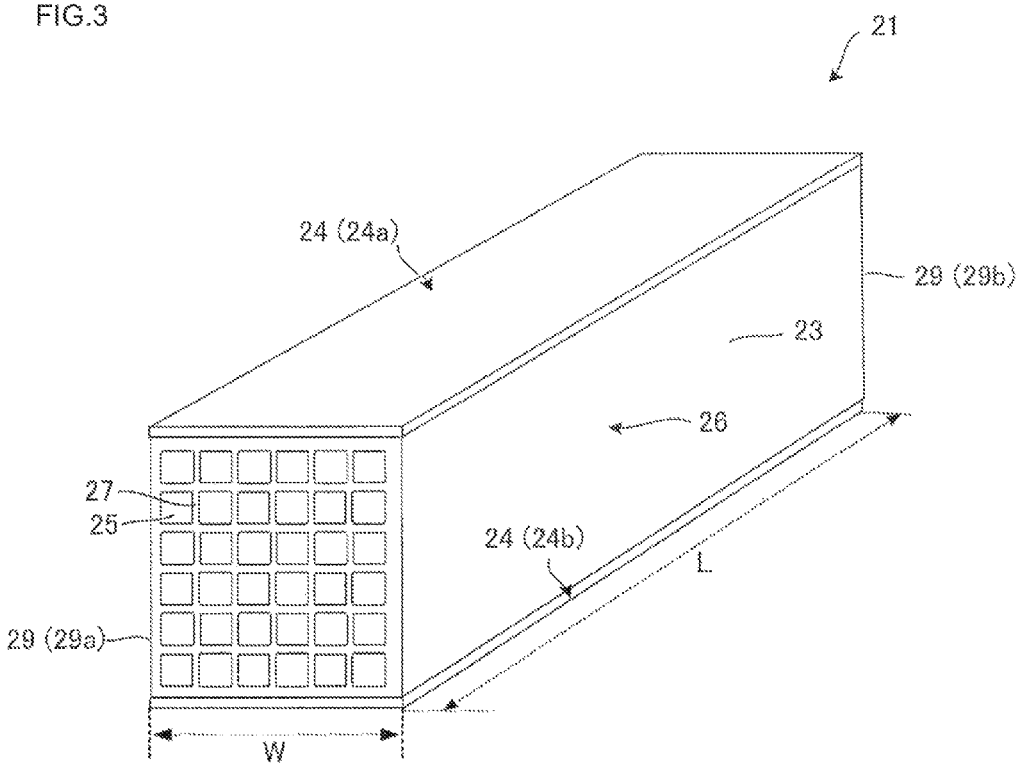
FIG. 3 is a perspective view showing another embodiment of the heater of the present invention.

FIG. 3 is a perspective view showing another embodiment of the heater of the present invention. A heater 21 of the present embodiment includes a honeycomb structure section 26 and a pair of electrodes 24 (an anode 24*a* and a cathode 24*b*). In the honeycomb structure section 26, the interior of a hollow quadrangular pillar-like outer peripheral wall 23 is partitioned by partition walls 27. Specifically, when the honeycomb structure section is seen from a cross section perpendicular to a cell extending direction (a direction of a length L), the interior surrounded with the outer peripheral wall 23 is quadrangularly partitioned, as in squares of a graph paper, by the mutually orthogonal partition walls 7. In consequence, a plurality of cells 25 are formed in the interior of the outer peripheral wall 23. The plurality of cells 25 extend through the interior surrounded with the outer peripheral wall 23 from an end 29*a* to an end 29*b*. Moreover, when the heater 21 of the present embodiment is seen from the cross section perpendicular to the direction of the length L, the outer peripheral wall 23 is a square having a width W which is a length of one side. Moreover, the electrode 24 (the anode 24*a* or the cathode 24*b*) is joined to each of a pair of parallel surfaces in four surfaces of the outer peripheral wall 23 of the honeycomb structure section 26. A width and a length of each of the anode 24*a* and the cathode 24*b* are the same as those of each surface of the outer peripheral wall 23 joined to the electrode (the width W×the length L). That is, each of the anode 24*a* and the cathode 24*b* is disposed to cover the whole "surface of the outer peripheral wall 23 joined to the electrode". When the heater 21 of the present embodiment having such a configuration has, for example, the following shape and is operated with a voltage of 36 V and a heater output of 4 kW, a watt density of 3.5 W/cm$^2$ or smaller can be realized even in a case where the length L of the heater 21 is from 30 to 100 mm. In the above shape, the width W of the outer peripheral wall 23 is 25 mm, a thickness of the outer peripheral wall 23 is 1 mm, thicknesses of the partition walls 27 are from 0.25 to 0.51 mm, a cell density is from 15 to 62 cells/cm$^2$, and specific electrical resistances of the partition walls 27 and the outer peripheral wall 23 are from 0.1 to 3 Ω·cm. It is to be noted that the watt density mentioned herein means a power per unit surface area of a heat release portion of the heater. Therefore, in the heater 21 of the present embodiment, the watt density means a power per unit surface area of the partition walls 27. Moreover, a watt density of 3.5 W/cm$^2$ is usually about the same size as a limit value (referred to as "the allowable watt density") at which a lubricating fluid for use in a machine is not excessively heated. That is, in the above-mentioned configuration and use mode, the lubricating fluid for use in the machine is not excessively heated, and it is possible to rapidly raise a temperature of the lubricating fluid, even in a state where the heater 21 of the present embodiment is miniaturized as 40 mm×40 mm×40 mm.

The heater 1 shown in FIG. 1 and the heater 21 shown in FIG. 3 may include a mechanism to stop electrical conduction into the honeycomb structure section 6, when a temperature of a lubricating fluid flowing into the end 9*a* is a predetermined value or lower. An adequate temperature can be obtained to such an extent that the lubricating fluid is not deteriorated, by this mechanism.

The heater 1 and the heater 21 may be used only when the lubricating fluid has a low temperature. In this case, the heater 1 or 21 is preferably used together with another type of heater (e.g., the heater disclosed in Patent Documents 1 to 3) including a mechanism to stop heating when the lubricating fluid has a predetermined temperature or higher. When two types of heaters are used together in this manner, the lubricating fluid having the low temperature is rapidly warmed to a predetermined temperature by use of the heater 1 or 21. Afterward, it is possible to hold the lubricating fluid at the predetermined temperature by the other type of heater. When the two types of heaters are used together in this manner, the other type of heater to be used together does not have to include a function of rapidly raising the temperature of the lubricating fluid. Therefore, a size of this other type of heater can be made small. In consequence, when the two types of small heaters are provided, the heaters can be used also in a small-sized apparatus. Moreover, a purpose of heating the lubricating fluid to rapidly lower a viscosity thereof can sufficiently be achieved.

Figure 4A:
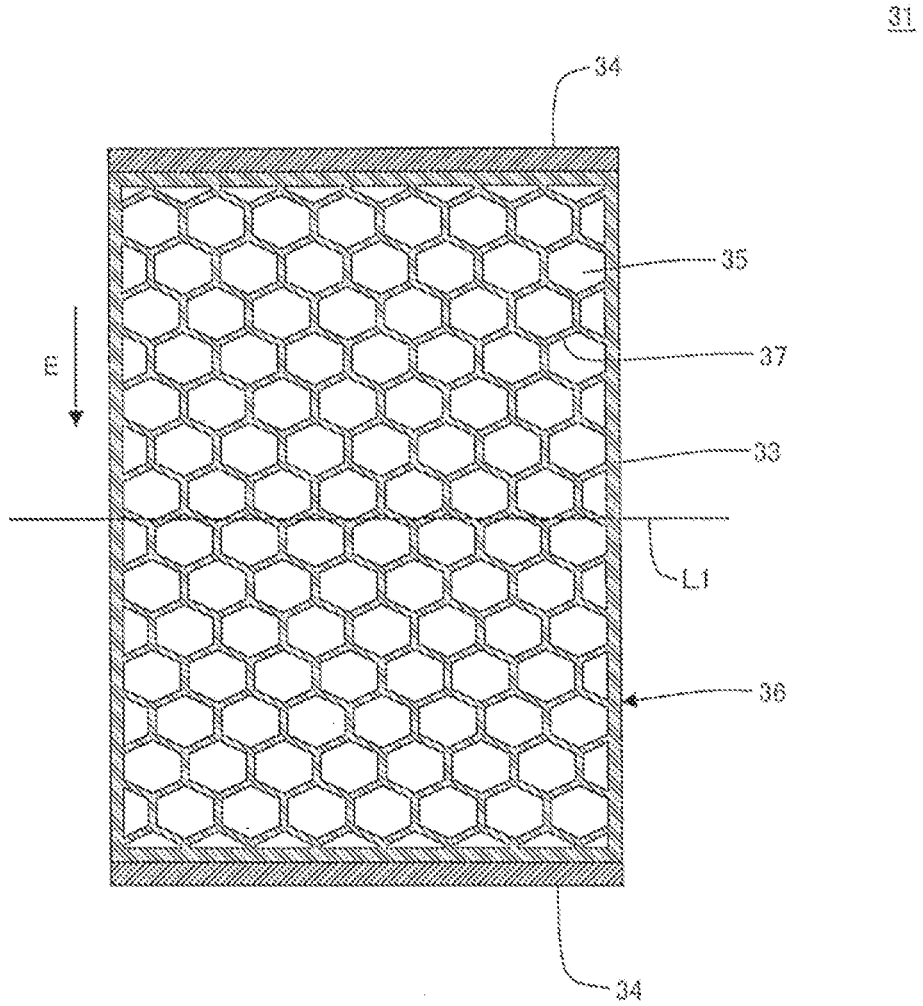
FIG. 4A is a schematic view showing a cross section orthogonal to a cell extending direction in still another embodiment of the heater of the present invention.

Next, still another embodiment of the heater of the present invention will be described. As shown in FIG. 4A, a direction E from one electrode 34 (an anode) to another electrode 34 (a cathode) in a cross section orthogonal to an extending direction of cells 35 is "the current direction E". This embodiment of the heater of the present invention does not include partition walls orthogonal to the current direction E. In other words, in a heater 31 of the present embodiment, all partition walls form an angle of "0° or larger and smaller than 90°" with respect to the current direction E (as a supplementary angle, an angle of "180° or smaller and over 90") in a cross section orthogonal to the extending direction of the cells 35. It is to be noted that two types of angles formed by the partition walls and the current direction E are present (when the two types of the angle are added up, 180° is obtained) except 0° and 90°. Here, the above "angle formed by the partition walls and the current direction E" indicates a smaller angle of the two types of angles. "The supplementary angle" is a larger angle. Moreover, when "the partition walls form an angle of 0° with respect to the current direction E", the partition walls are parallel to the current direction E. Here, "the partition walls orthogonal to the direction from one electrode to the other electrode" have a substantially equal potential in the whole partition walls, when a voltage is applied to the heater. Therefore, the current hardly flows through "the partition walls orthogonal to the direction from the one electrode to the other electrode", and heat is hardly generated. On the other hand, the heater 31 of the embodiment does not include the partition walls orthogonal to the current direction E, and hence it is possible to generate heat from all the partition walls. In consequence, it is possible to further miniaturize the heater 31. FIG. 4A is a schematic view showing a cross section orthogonal to the cell extending direction in the embodiment of the heater of the present invention.

Here, the meaning of "the direction (the current direction) from the one electrode to the other electrode" is as follows.

Figure 4B:
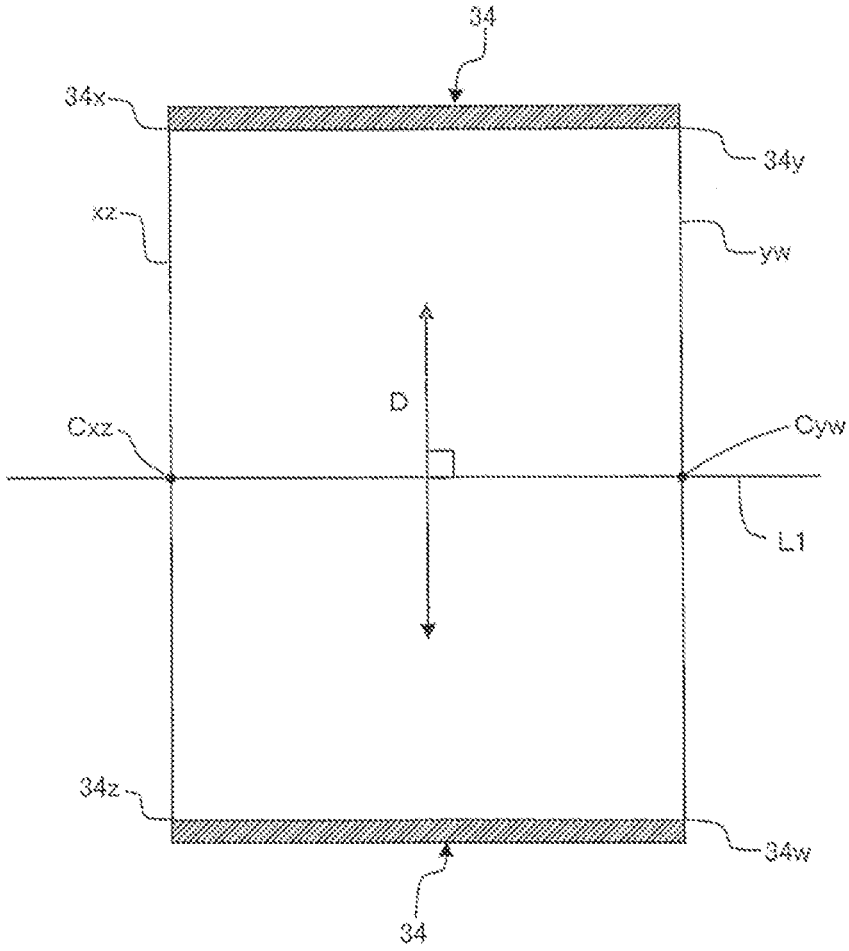
FIG. 4B is a schematic view showing a relation between a pair of electrodes and a current direction in the embodiment of the heater of the present invention.

First, as shown in FIG. 4B, both ends 34*x* and 34*y* of the one electrode 34 are connected to both ends 34*z* and 34*w* of the other electrode 34 by segments xz and yw, respectively, so that the segments do not intersect. At this time, a direction D orthogonal to a straight line L1 connecting midpoints Cxz and Cyw of the respective segments (two segments) xz and yw to each other means the above direction. "The straight line L1" is a straight line passing through the midpoints Cxz and Cyw. For example, in the case of the heater 31 shown in FIG. 4A, the pair of electrodes 34 and 34 linearly extending in the cross section orthogonal to the extending direction of the cells 35 are arranged in parallel. Therefore, the straight line L1 is parallel to the respective electrodes 34 and 34. Therefore, a direction orthogonal to the respective electrodes 34 and 34 is the current direction E. Moreover, it can be considered that the partition walls "orthogonal to the direction (the current direction) from the one electrode to the other electrode" are partition walls parallel to the straight line L1. FIG. 4B is a schematic view showing a relation between the pair of electrodes and the current direction in this embodiment of the heater of the present invention.

In a honeycomb structure section 36 constituting the heater 31 of the present embodiment, the plurality of cells 35 which become through channels of a lubricating fluid are formed by partition walls 37 as shown in FIG. 4A. Moreover, the honeycomb structure section 36 includes an outer peripheral wall 33 in an outer periphery. Moreover, in a cross section orthogonal to the extending direction of the cells 35, a shape of the cells 35 is a hexagonal shape, and an outer peripheral shape of the honeycomb structure section 36 is rectangular. Moreover, the pair of electrodes 34 and 34 are disposed on surfaces (outer peripheral wall surfaces) of a pair of parallel sides of the rectangular honeycomb structure section 36, respectively, in the cross section orthogonal to the extending direction of the cells 35. In the heater 31 of the present embodiment, the current direction E of a diagonal direction of the hexagonal cells 35 in the cross section orthogonal to the extending direction of the cells 35. Therefore, all sizes (six sides) of each hexagonal cell 35 are not orthogonal to the current direction E. In the cross section orthogonal to the extending direction of the cells 35, an angle between the partition walls and the current direction E (the smaller angle) is 0° or 60°.

Figure 5:
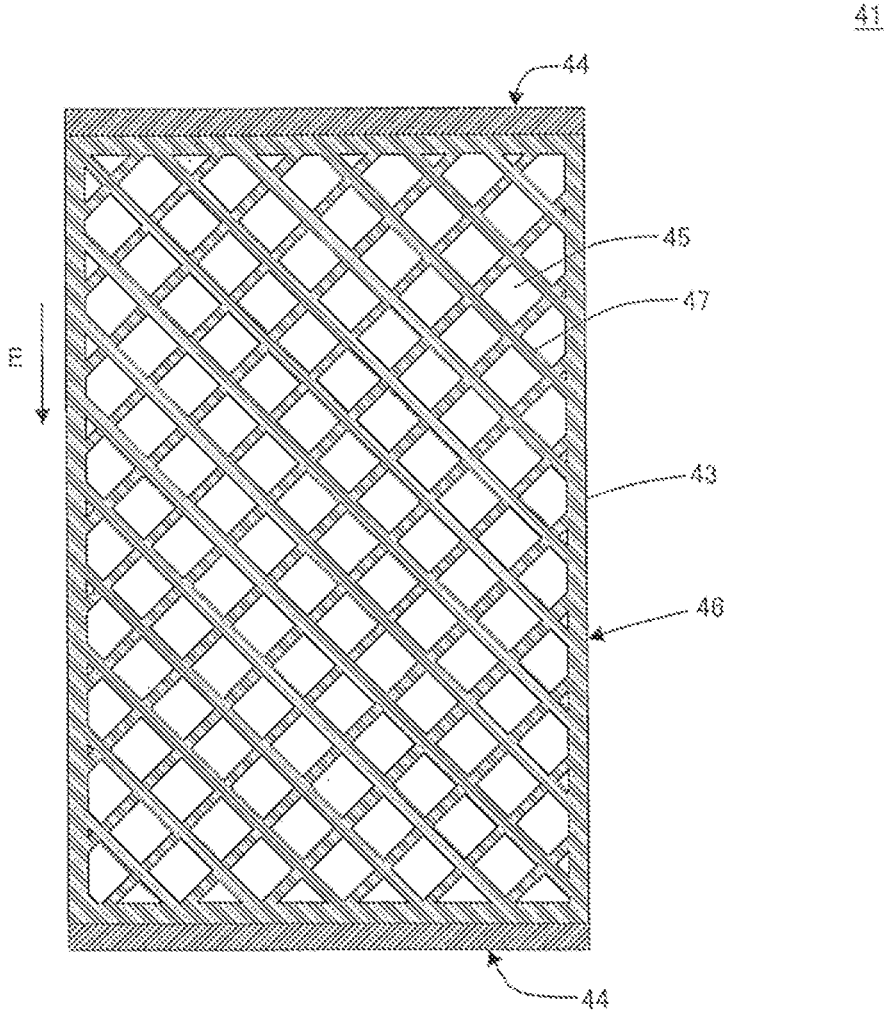
FIG. 5 is a schematic view showing a cross section orthogonal to a cell extending direction in a further embodiment of the heater of the present invention.

Next, a further embodiment of the heater of the present invention will be described. As shown in FIG. 5, a heater 41 of the present embodiment includes a tubular honeycomb structure section 46 including partition walls 47 to partition and form a plurality of cells 45 which become through channels of a lubricating fluid and extend from one end surface to the other end surface, and an outer peripheral wall 43 positioned in an outer periphery. Furthermore, the heater 41 of the present embodiment includes a pair of electrodes 44 and 44 in the outer periphery of the honeycomb structure section 46. Further in a cross section orthogonal to an extending direction of the cells 45, a shape of the cells 45 is a rectangular shape (a square shape), and an outer peripheral shape of the honeycomb structure section 46 is rectangular. Moreover, the pair of electrodes 44 and 44 are disposed on surfaces (outer peripheral wall surfaces) of a pair of parallel sides of the rectangular honeycomb structure section 46, respectively, in the cross section orthogonal to the extending direction of the cells 45. FIG. 5 is a schematic view showing the cross section orthogonal to the cell extending direction in this further embodiment of the heater of the present invention.

The heater 41 of the present embodiment does not include partition walls orthogonal to a direction E (the current direction E) from the one electrode 44 to the other electrode 44 in the cross section orthogonal to the extending direction of the cells 45. Thus, the heater 41 of the present embodiment does not include the partition walls orthogonal to the current direction E, and hence it is possible to generate heat from all the partition walls. In consequence, it is possible to further miniaturize the heater 41. In the heater 41 of the present embodiment, the current direction E becomes a diagonal direction of the rectangular cells 45, in the cross section orthogonal to the extending direction of the cells 45. That is, an angle (a smaller angle) between all the sides (four sides) of each rectangular cell 45 and the current direction E is 45°.

Figure 6:
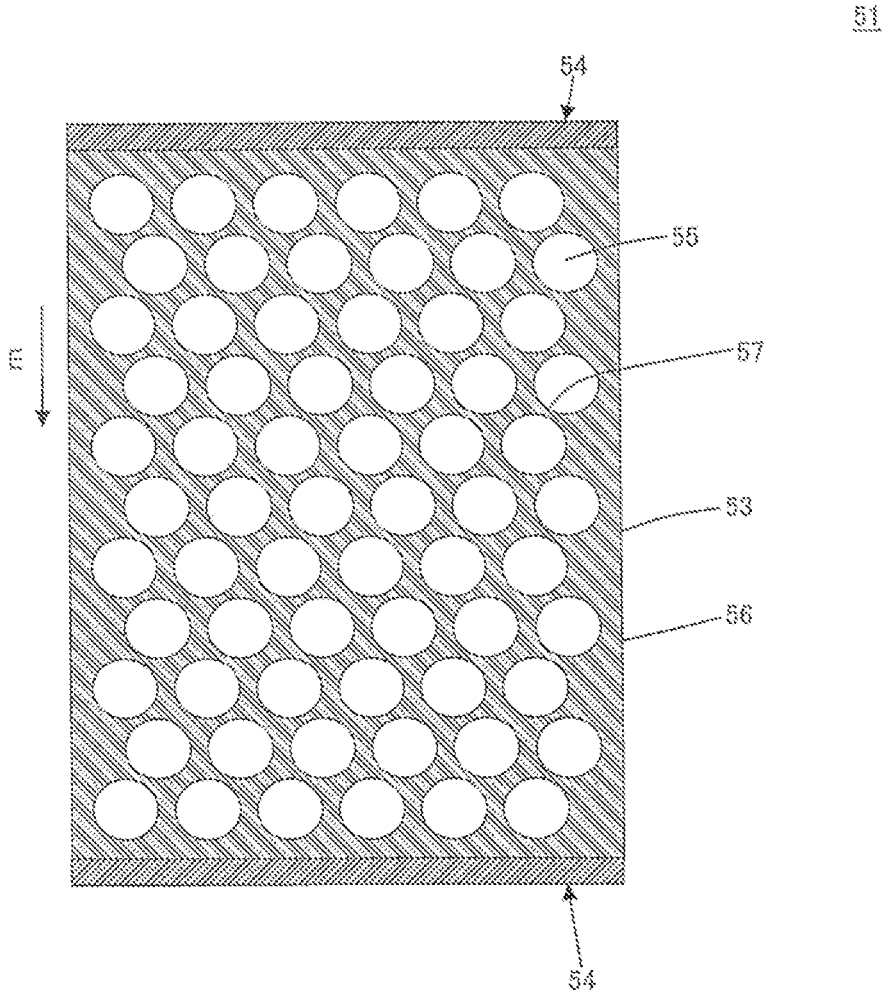
FIG. 6 is a schematic view showing a cross section orthogonal to a cell extending direction in a further embodiment of the heater of the present invention.

Next, a further embodiment of the heater of the present invention will be described. As shown in FIG. 6, a heater 51 of the present embodiment includes a tubular honeycomb structure section 56 including partition walls 57 to partition and form a plurality of cells 55 which become through channels of a lubricating fluid and extend from one end surface to the other end surface, and an outer peripheral wall 53 positioned in an outer periphery. Furthermore, the heater 51 of the present embodiment includes a pair of electrodes 54 and 54 in the outer periphery of the honeycomb structure section 56. Further in a cross section orthogonal to an extending direction of the cells 55, a shape of the cells 55 is a circular shape, and a shape of the honeycomb structure section 56 is rectangular. Moreover, the pair of electrodes 54 and 54 are disposed on surfaces (outer peripheral wall surfaces) of a pair of parallel sides of the rectangular honeycomb structure section 56, respectively, in the cross section orthogonal to the extending direction of the cells 55. FIG. 6 is a schematic view showing the cross section orthogonal to the cell extending direction in this further embodiment of the heater of the present invention.

The heater 51 of the present embodiment does not include partition walls orthogonal to a direction E (the current direction E) from the one electrode 54 to the other electrode 54, in the cross section orthogonal to the extending direction of the cells 55. Thus, the heater 51 of the present embodiment does not include the partition walls orthogonal to the current direction E, and hence it is possible to generate heat from all the partition walls. In consequence, it is possible to further miniaturize the heater 51.

When a shape of the cells 55 is the circular shape in the cross section orthogonal to the extending direction of the cells 55 as in the heater 51 of the present embodiment, an extending direction of the partition walls 57 is a direction orthogonal to "a segment connecting centers of two circular cells 55 and 55 adjacent via the partition wall 57". The above "extending direction of the partition walls 57" is a direction which specifies an angle of the partition walls 57 with the current direction E. Therefore, in the heater 51 of the present embodiment, all "segments connecting centers of two adjacent cells 55 and 55" are not parallel to the current direction E.

Figure 7:
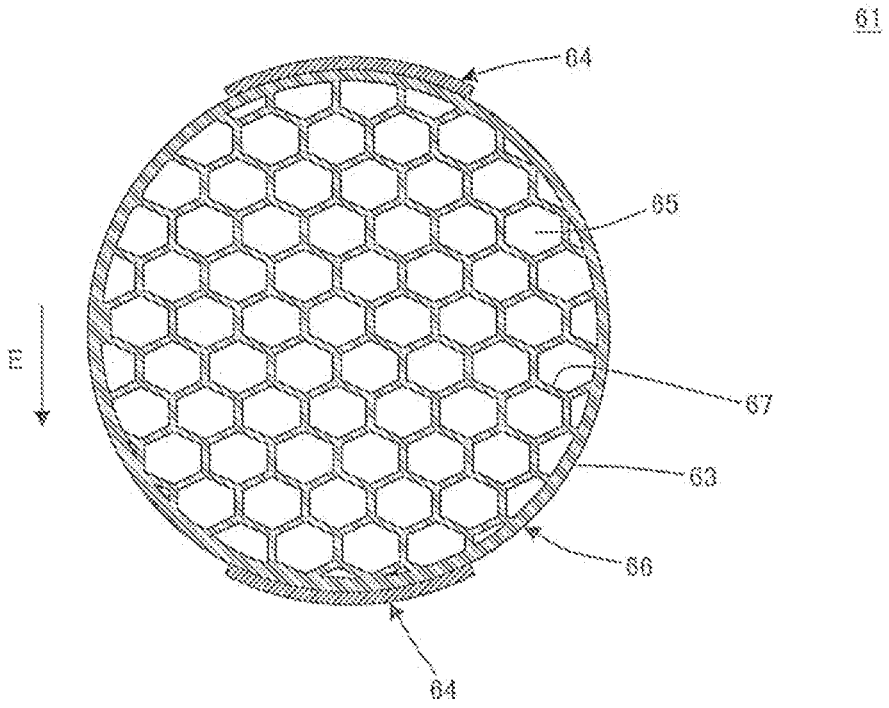
FIG. 7 is a schematic view showing a cross section orthogonal to a cell extending direction in a further embodiment of the heater of the present invention.

Next, a further embodiment of the heater of the present invention will be described. As shown in FIG. 7, a heater 61 of the present embodiment includes a tubular honeycomb structure section 66 including partition walls 67 to partition and form a plurality of cells 65 which become through channels of a lubricating fluid and extend from one end surface to the other end surface, and an outer peripheral wall 63 positioned in an outer periphery. Furthermore, the heater 61 of the present embodiment includes a pair of electrodes 64 and 64 in the outer periphery of the honeycomb structure section 66. Further in a cross section orthogonal to an extending direction of the cells 65, a shape of the cells 65 is a hexagonal shape, and an outer peripheral shape of the honeycomb structure section 66 is circular. FIG. 7 is a schematic view showing the cross section orthogonal to the cell extending direction in this further embodiment of the heater of the present invention.

The heater 61 of the present embodiment does not include partition walls orthogonal to a direction E (the current direction E) from the one electrode 64 to the other electrode 64, in the cross section orthogonal to the extending direction of the cells 65. Thus, the heater 61 of the present embodiment does not include partition walls orthogonal to the current direction E, and hence it is possible to generate heat from all the partition walls. In consequence, it is possible to further miniaturize the heater 61.

In the heater 61 of the present embodiment, the electrodes 64 and 64 are formed circularly along the outer periphery of the honeycomb structure section 66, respectively, in the cross section orthogonal to the extending direction of the cells 65. Further in the cross section orthogonal to the extending direction of the cells 65, the one electrode 64 of the pair of electrodes 64 and 64 is disposed on a side opposite to the other electrode 64 of the pair of electrodes 64 and 64 via the center of the honeycomb structure section 66.

Moreover, a length of the one electrode 64 in the cross section orthogonal to the extending direction of the cells 65 (a length in a peripheral direction of the honeycomb structure section 66) is preferably from 5 to 40% of a length of an outer periphery of the honeycomb structure section 66 in the cross section orthogonal to the extending direction of the cells 65. Moreover, lengths of the pair of electrodes 64 and 64 are preferably the same, but may be different.

Moreover, the electrode 64 may be disposed on a side surface of the honeycomb structure section 66 to extend between both ends of the honeycomb structure section 66 in the cell extending direction, or a space may be made between the end of the electrode 64 and the end of the honeycomb structure section 66. When the electrode 64 is disposed on the side surface of the honeycomb structure section 66 to extend between both the ends of the honeycomb structure section 66 in the cell extending direction, the electrode 64 and the honeycomb structure section 66 are disposed as follows. That is, a length of the electrode 64 in the cell extending direction is the same as a length of the honeycomb structure section 66 in the cell extending direction. Moreover, when a space is made between the end of the electrode 64 and the end of the honeycomb structure section 66, the length of the electrode 64 in the cell extending direction is smaller than that of the honeycomb structure section 66 in the cell extending direction.

Figure 8:
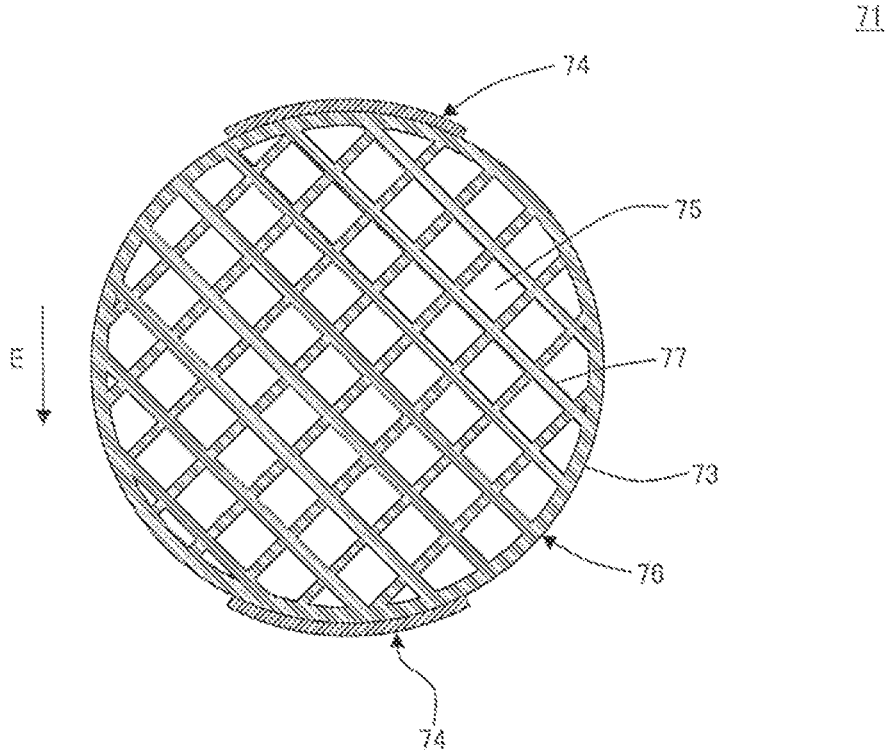
FIG. 8 is a schematic view showing a cross section orthogonal to a cell extending direction in a further embodiment of the heater of the present invention.

Next, a further embodiment of the heater of the present invention will be described. As shown in FIG. 8, a heater 71 of the present embodiment includes a tubular honeycomb structure section 76 including partition walls 77 to partition and form a plurality of cells 75 which become through channels of a lubricating fluid and extend from one end surface to the other end surface, and an outer peripheral wall 73 positioned in an outer periphery. Furthermore, the heater 71 of the present embodiment includes a pair of electrodes 74 and 74 in the outer periphery of the honeycomb structure section 76. Further in a cross section orthogonal to an extending direction of the cells 75, a shape of the cells 75 is a rectangular shape (a square shape), and an outer peripheral shape of the honeycomb structure section 76 is circular. As shown in FIG. 8, in the heater 71 of the present embodiment, a shape of the cells in the cross section orthogonal to the cell extending direction of the heater 61 (see FIG. 7) of the embodiment of the heater of the present invention is a rectangular shape (a square shape). FIG. 8 is a schematic view showing the cross section orthogonal to the cell extending direction in this further embodiment of the heater of the present invention.

The heater 71 of the present embodiment does not include partition walls orthogonal to a direction E (the current direction E) from the one electrode 74 to the other electrode 74, in the cross section orthogonal to the extending direction of the cells 75. Thus, the heater 71 of the present embodiment does not include the partition walls orthogonal to the current direction E, and hence it is possible to generate heat from all the partition walls. In consequence, it is possible to further miniaturize the heater 71. In the heater 71 of the present embodiment, the current direction E becomes a diagonal direction of the rectangular cells 75, in the cross section orthogonal to the extending direction of the cells 75. An angle between all sides (four sides) of the rectangular cell 75 and the current direction E is 45°.

Figure 9:
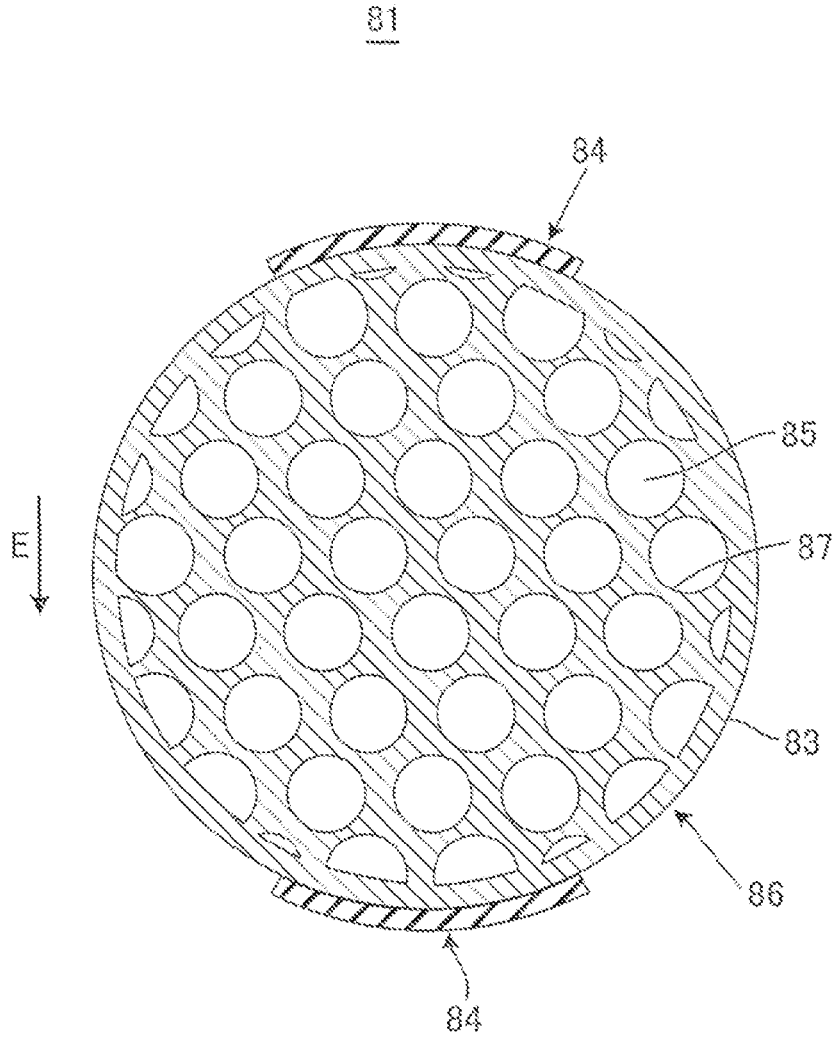
FIG. 9 is a schematic view showing a cross section orthogonal to a cell extending direction in a further embodiment of the heater of the present invention.

Next, a further embodiment of the heater of the present invention will be described. As shown in FIG. 9, a heater 81 of the present embodiment includes a tubular honeycomb structure section 86 including partition walls 87 to partition and form a plurality of cells 85 which become through channels of a lubricating fluid and extend from one end surface to the other end surface, and an outer peripheral wall 83 positioned in an outer periphery. Furthermore, the heater 81 of the present embodiment includes a pair of electrodes 84 and 84 in the outer periphery of the honeycomb structure section 86. Further in a cross section orthogonal to an extending direction of the cells 85, a shape of the cells 85 is a circular shape, and an outer peripheral shape of the honeycomb structure section 86 is circular. As shown in FIG. 9, in the heater 81 of the present embodiment, a shape of the cells in the cross section orthogonal to the cell extending direction of the heater 61 (see FIG. 7) of the embodiment of the heater of the present invention is a circular shape. FIG. 9 is a schematic view showing the cross section orthogonal to the cell extending direction in this further embodiment of the heater of the present invention.

The heater 81 of the present embodiment does not include partition walls orthogonal to a direction E (the current direction E) from the one electrode 84 to the other electrode 84, in the cross section orthogonal to the extending direction of the cells 85. Thus, the heater 81 of the present embodiment does not include the partition walls orthogonal to the current direction E, and hence it is possible to generate heat from all the partition walls. In consequence, it is possible to further miniaturize the heater 81.

Figure 10:
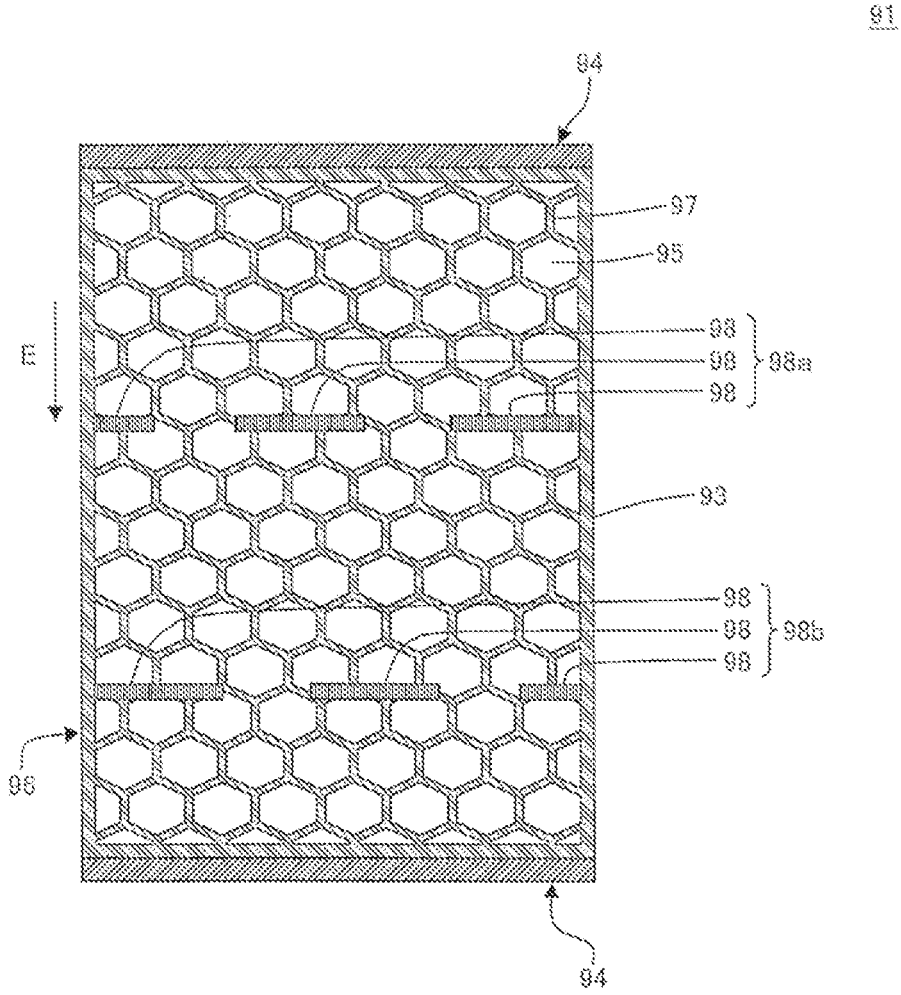
FIG. 10 is a schematic view showing a cross section orthogonal to a cell extending direction in a further embodiment of the heater of the present invention.
Figure 11:
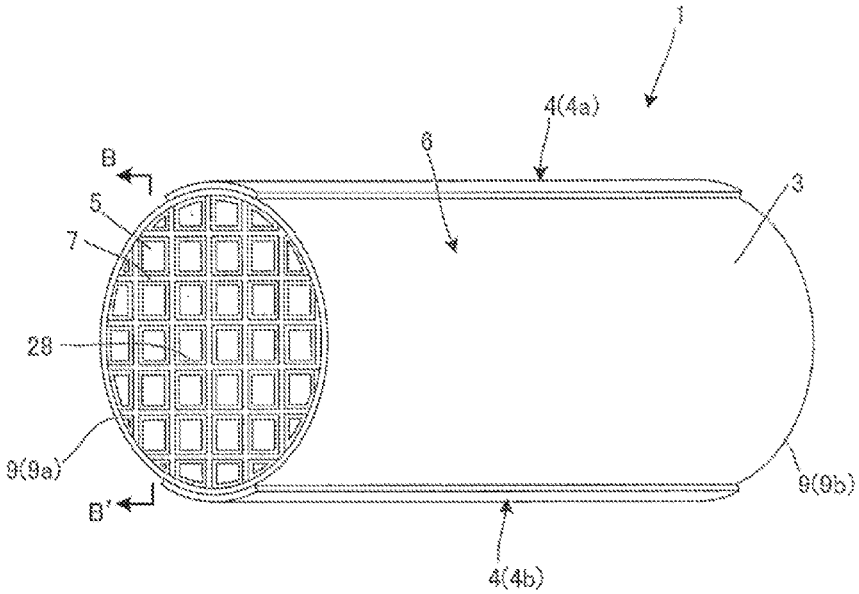
FIG. 11 is a perspective view showing a still further embodiment of the heater of the present invention.
Figure 12:
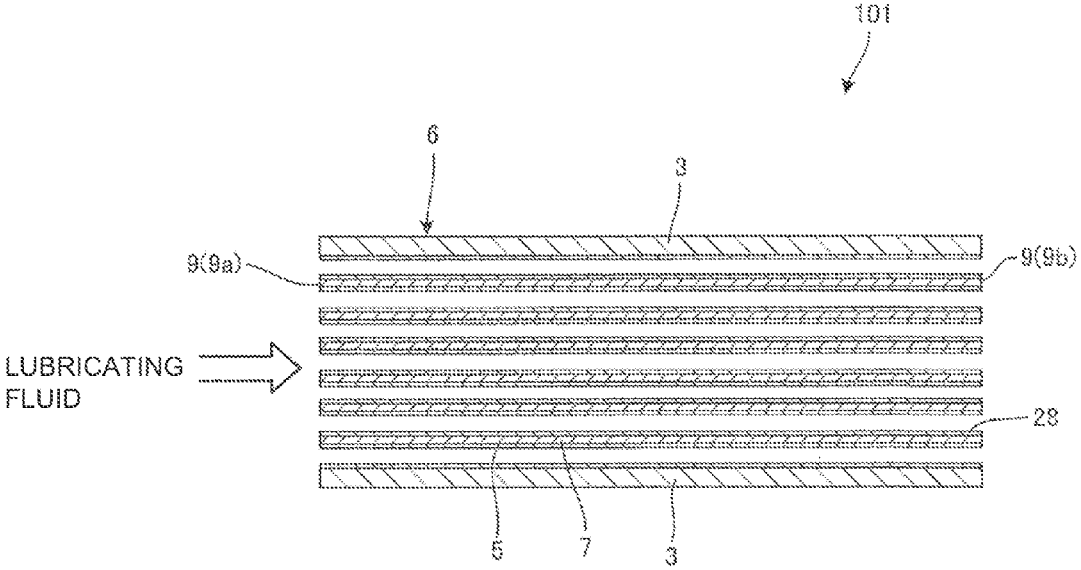
FIG. 12 is a schematic view showing a cross section cut along the B-B' line of FIG. 11.

Next, a still further embodiment of the heater of the present invention will be described. As shown in FIG. 10, a heater 91 of the present embodiment includes a tubular honeycomb structure section 96 including partition walls 97 to partition and form a plurality of cells 95 which become through channels of a lubricating fluid and extend from one end surface to the other end surface, and an outer peripheral wall 93 positioned in an outer periphery. Furthermore, the heater 91 of the present embodiment includes a pair of electrodes 94 and 94 in the outer periphery of the honeycomb structure section 96. In addition, the heater 91 of the present embodiment includes current collecting layers 98 orthogonal to a direction (the current direction E) from the one electrode 94 to the other electrode 94, in the cross section orthogonal to the extending direction of the cells 95. That is, the current collecting layers 98 are arranged to be orthogonal to the current direction E, in the cross section orthogonal to the extending direction of the cells 95. Therefore, when a voltage is applied to the heater 91, a potential on the current collecting layers 98 is constant. Therefore, the current collecting layers are portions which do not easily generate heat. FIG. 10 is a schematic view showing the cross section orthogonal to the cell extending direction in this still further embodiment of the heater of the present invention.

Thus, the heater 91 of the present embodiment includes the current collecting layers 98, and hence a further uniform current can flow through the partition walls 97.

In the heater of the present invention, the current uniformly flows through the honeycomb structure section, and hence the partition walls constituting the honeycomb structure section are preferably uniformly formed. However, the partition walls form a complicated fine honeycomb structure, and hence a slight deviation occurs in a shape and a material sometimes. Thus, when the deviation occurs in the shape or material of the partition walls and a voltage is applied to the heater (the pair of electrodes), the current does not easily uniformly flow. On the other hand, when the voltage is applied to the heater 91 of the present embodiment, the current flowing out of the electrode (the anode) becomes slightly non-uniform when flowing through the partition walls. Even in this case, when the current passes through the current collecting layers 98, the current uniformly spreads in the current collecting layers 98. Therefore, the current is uniformly supplied from the current collecting layers to the partition walls. In consequence, when the voltage is applied to the heater 91 of the present embodiment, the current flowing through the partition walls entirely becomes further uniform.

In the heater 91 of the present embodiment, a shape of the cells 95 is a hexagonal shape, and an outer peripheral shape of the honeycomb structure section 96 is rectangular, in the cross section orthogonal to an extending direction of the cells 95. A length of each current collecting layer 98 in the cell extending direction is preferably the same as that of the electrode 94 in the cell extending direction.

As shown in FIG. 10, the heater 91 of the present embodiment includes the current collecting layers 98 orthogonal to the current direction E, in the cross section orthogonal to the cell extending direction of the heater 31 (see FIG. 4A) of the embodiment of the heater of the present invention.

In the heater 91 of the present embodiment, a material of the current collecting layers 98 may be the same as or different from a material of the partition walls.

When the material of the current collecting layers is the same as that of the partition walls, the current collecting layers are preferably formed integrally with the partition walls. "The current collecting layers are formed integrally with the partition walls" means a state where any boundaries are not present between the current collecting layer and the partition wall, and the materials thereof are continuously disposed. For example, during extrusion forming of a ceramic raw material, the current collecting layers are formed together with the partition walls. Afterward, the current collecting layers are sintered together with the partition walls, whereby it is possible to obtain the honeycomb structure section in which the current collecting layers and the partition walls are integrally formed. According to this method, the current collecting layers can efficiently be formed. It is to be noted that when the current collecting layers are formed integrally with the partition walls, the current collecting layers are preferably thicker than the partition walls. Moreover, the cross section orthogonal to the cell extending direction is "an orthogonal cross section". When a plurality of "regularly arranged" cells are partitioned and formed in the orthogonal cross section by the partition walls, "the partition walls orthogonal to the current direction" are formed against the regularity of the cells. In this case, "the partition walls orthogonal to the current direction" do not become the partition walls but become the current collecting layers. It can be considered that the above "against the regularity of the cells" means that "a shape of part of the cells is irregularly deformed". For example, the heater 91 shown in FIG. 10 is an example in which the partition walls and the current collecting layers are not integrally formed. A relation between the partition wall and the current collecting layer lies in that "in the partition walls which partition and form regularly arranged hexagonal cells, the current collecting layers are formed so that the hexagonal cells are not formed (the hexagonal cells are deformed in another shape".

Moreover, when the material of the current collecting layers is the same as that of the partition walls, the current collecting layers do not have to be integrally formed with the partition walls. The honeycomb structure section in which the current collecting layers and the partition walls are integrally formed is preferably prepared, for example, as follows. First, the honeycomb structure section provided with "cuts (holes having the same shape as the current collecting layers)" for inserting the current collecting layers is formed. Next, the current collecting layers are prepared separately from the honeycomb structure section. Afterward, the current collecting layers are inserted into "the cuts" of the honeycomb structure section. Thus, the honeycomb structure section including the current collecting layers is preferably prepared. Moreover, the honeycomb structure section can be prepared as follows. First, a plurality of honeycomb formed bodies are formed by extrusion forming of a ceramic material. Next, the current collecting layers are prepared. Next, a plurality of honeycomb formed body are laminated while the current collecting layer is sandwiched therebetween, followed by sintering. In this way, the honeycomb structure section including the current collecting layers may be prepared. Also when the material of the current collecting layers is different from that of the partition walls, the above preparing method can be employed. That is, it is possible to employ the method of inserting the current collecting layers into "the honeycomb structure section in which the cuts are formed", or the manufacturing method of sandwiching the plurality of honeycomb formed bodies between the current collecting layers and sintering the bodies in this state to form the honeycomb structure section.

Moreover, when the material of the current collecting layers is different from that of the partition walls, a specific electrical resistance (Ω·cm) of each current collecting layer is preferably smaller than a specific electrical resistance (Ω·cm) of each partition wall. When the specific electrical resistance of the current collecting layer is smaller than that of the partition wall, an effect that "the current flowing through the honeycomb structure section is made uniform" by the current collecting layers becomes higher.

As shown in FIG. 10, in the heater 91 of the present embodiment, the plurality of current collecting layers 98 are arranged via spaces, respectively, at positions having the same distance from the one electrode 94 (the current collecting layers are arranged in a direction orthogonal to the current direction E). In other words, in the heater 91 of the present embodiment, the plurality of current collecting layers 98 are arranged via the spaces, respectively, so that the layers are arranged in the direction orthogonal to the current direction E, in the cross section orthogonal to the cell extending direction. In the heater 91 of the present embodiment, the plurality of current collecting layers 98 are arranged via the spaces, respectively, in the direction orthogonal to the current direction E. However, one current collecting layer may be disposed to extend in the direction orthogonal to the current direction E. When the one current collecting layer is disposed to extend in the direction orthogonal to the current direction E, the space in the direction orthogonal to the current direction E is not present. In this manner, also when the one current collecting layer is disposed to extend in the direction orthogonal to the current direction E, there is produced an effect that the current is collected by the current collecting layer once and the current is made uniform in the direction orthogonal to the current direction E. The plurality of current collecting layers 98 arranged in the direction orthogonal to the current direction E in the cross section orthogonal to the cell extending direction is referred to as "an iso-potential current collecting layer group".

In the heater 91 of the present embodiment, three current collecting layers are arranged at the positions having the same distance from the one electrode 94 (arranged in the direction orthogonal to the current direction E in the cross section orthogonal to the cell extending direction).

Moreover, as shown in FIG. 10, the heater 91 of the present embodiment includes two "iso-potential current collecting layer groups 98*a* and 98*b*" having different distances from the one electrode 94 in the cross section orthogonal to the cell extending direction. There are not any special restrictions on a distance between the electrode and the iso-potential current collecting layer group and a distance between the iso-potential current collecting layer groups.

EXAMPLES

Hereinafter, the present invention will specifically be described with respect to examples, but the present invention is not limited to these examples.

Example 1

First, a honeycomb structure section content Si-bonded SiC as a main component was prepared. Specifically, SiC powder, metal Si powder, water and an organic binder were mixed and kneaded to prepare a kneaded material. Next, this kneaded material was formed in a honeycomb shape to prepare a honeycomb formed body. Next, the obtained honeycomb formed body was sintered in an inert gas atmosphere, to prepare the honeycomb structure section containing Si-bonded SiC as the main component.

Next, the side surface of the honeycomb structure section was coated with a silver (Ag) paste as an electrode forming raw material. Two portions of the side surface of the honeycomb structure section were coated with the electrode forming raw material. A shape of each coating film was a rectangular shape (a strip-like shape). Then, in a cross section orthogonal to an extending direction of cells, one of the two "coating films by the electrode forming raw material" was disposed on a side opposite to the other film via the center of a honeycomb formed body. Afterward, the body was degreased and sintered in an atmospheric furnace, to prepare a heater including the honeycomb structure section and a pair of electrodes. The Ag paste was a pasted material made of 40 to 95 mass % of silver.

A porosity of partition walls of the honeycomb structure section in the prepared heater was 40%. A cell shape of the honeycomb structure section was quadrangular. The cell shape of the honeycomb structure section is the cell shape in "the cross section orthogonal to the cell extending direction" of the honeycomb structure section. A specific electrical resistance (room temperature) of the heater was 30 Ω·cm. A cell density of the honeycomb structure section was 31 cells/$cm^2$. A partition wall thickness of the honeycomb structure section was 0.3 mm. A thickness of an outer peripheral wall of the honeycomb structure section was 0.5 mm. A shape of an end surface of the honeycomb structure section (the cross section orthogonal to the cell extending direction) was a square, and a length of one side of the square (the length of the side of the cross section) was 40 mm. A length of the honeycomb structure section in the cell extending direction (the length of the honeycomb structure section) was 50 mm. A volume of the honeycomb structure section was 80 $cm^3$. An electrical resistance of the heater was 37 Ω.

The obtained heater was subjected to "an electrical conduction test" by the following method.

(Electrical Conduction Test)

On the surface of the electrode of the prepared heater, a pure aluminum (Al) plate (a plate thickness of 0.5 mm) whose shape is easily deformed is disposed, and on the surface of the pure aluminum plate, a power conducting power source-side connecting portion (an electrode) is disposed. That is, the pure aluminum plate is sandwiched between the electrode of the heater and the power conducting power source-side connecting portion (the electrode). Next, the electrode of the heater is mechanically (by bolt fastening) connected to the power conducting power source-side connecting portion (the electrode). Next, a predetermined voltage is applied to this heater, and an output (kW) obtained when the predetermined voltage is applied is confirmed.

In Example 1, when a voltage of 300.0 V was applied, an output of 2.4 kW was obtained. In the column of "output (kW)" of Table 1, the result of "electrical conduction test" is shown.

TABLE 1

| | Material | Porosity (%) | Cell shape | Specific electrical resistance (Ω · cm) | Cell density (cells/$cm^2$) | Partition wall thickness (mm) | Length of one side of cross section (mm) | Length of honeycomb structure section (mm) | Volume of honeycomb structure section ($cm^3$) | Resistance (Ω) | Voltage (V) | Output (kW) |
|---|---|---|---|---|---|---|---|---|---|---|---|---|
| Example 1 | Si-bonded SiC | 40 | Quadrangular | 30 | 31 | 0.3 | 40 | 50 | 80 | 37 | 300.0 | 2.4 |
| Example 2 | Si-bonded SiC | 40 | Quadrangular | 30 | 31 | 0.3 | 50 | 30 | 75 | 63 | 300.0 | 1.4 |
| Example 3 | Si-bonded SiC | 40 | Quadrangular | 30 | 47 | 0.3 | 40 | 50 | 80 | 31 | 300.0 | 2.9 |
| Example 4 | Si-bonded SiC | 40 | Quadrangular | 30 | 47 | 0.3 | 50 | 30 | 75 | 51 | 300.0 | 1.8 |
| Example 5 | Si-bonded SiC | 40 | Quadrangular | 30 | 93 | 0.1 | 40 | 50 | 80 | 66 | 300.0 | 1.4 |
| Example 6 | Si-bonded SiC | 40 | Quadrangular | 30 | 93 | 0.1 | 50 | 30 | 75 | 110 | 300.0 | 0.8 |
| Example 7 | Si-bonded SiC | 40 | Quadrangular | 0.5 | 31 | 0.3 | 40 | 50 | 80 | 0.62 | 40.0 | 2.6 |
| Example 8 | Si-bonded SiC | 40 | Quadrangular | 0.5 | 31 | 0.3 | 50 | 30 | 75 | 1.0 | 40.0 | 1.5 |
| Example 9 | Si-bonded SiC | 40 | Quadrangular | 0.5 | 47 | 0.3 | 40 | 50 | 80 | 0.51 | 40.0 | 3.1 |
| Example 10 | Si-bonded SiC | 40 | Quadrangular | 0.5 | 47 | 0.3 | 50 | 30 | 75 | 0.86 | 40.0 | 1.9 |
| Example 11 | Si-bonded SiC | 40 | Quadrangular | 0.5 | 93 | 0.1 | 40 | 50 | 80 | 1.1 | 40.0 | 1.5 |
| Example 12 | Si-bonded SiC | 40 | Quadrangular | 0.5 | 93 | 0.1 | 50 | 30 | 75 | 1.8 | 40.0 | 0.9 |
| Example 13 | Si-impregnated SiC | 0 | Quadrangular | 0.05 | 31 | 0.3 | 40 | 50 | 80 | 0.06 | 15.0 | 3.6 |
| Example 14 | Si-impregnated SiC | 0 | Quadrangular | 0.05 | 31 | 0.3 | 50 | 30 | 75 | 0.10 | 15.0 | 2.2 |
| Example 15 | Si-impregnated SiC | 0 | Quadrangular | 0.05 | 47 | 0.3 | 40 | 50 | 80 | 0.05 | 15.0 | 4.4 |

TABLE 1-continued

| | Material | Porosity (%) | Cell shape | Specific electrical resistance (Ω · cm) | Cell density (cells/cm$^2$) | Partition wall thickness (mm) | Length of one side of cross section (mm) | Length of honeycomb structure section (mm) | Volume of honeycomb structure section (cm$^3$) | Resistance (Ω) | Voltage (V) | Output (kW) |
|---|---|---|---|---|---|---|---|---|---|---|---|---|
| Example 16 | Si-impregnated SiC | 0 | Quadrangular | 0.05 | 47 | 0.3 | 50 | 30 | 75 | 0.09 | 15.0 | 2.6 |
| Example 17 | Si-impregnated SiC | 0 | Quadrangular | 0.05 | 93 | 0.1 | 40 | 50 | 80 | 0.11 | 15.0 | 2.1 |
| Example 18 | Si-impregnated SiC | 0 | Quadrangular | 0.05 | 93 | 0.1 | 50 | 30 | 75 | 0.18 | 15.0 | 1.2 |
| Example 19 | Recrystallized SiC | 40 | Quadrangular | 1 | 31 | 0.3 | 40 | 50 | 80 | 1.2 | 60.0 | 2.9 |
| Example 20 | Recrystallized SiC | 40 | Quadrangular | 1 | 31 | 0.3 | 50 | 30 | 75 | 2.1 | 60.0 | 1.7 |
| Example 21 | Recrystallized SiC | 40 | Quadrangular | 1 | 47 | 0.3 | 40 | 50 | 80 | 1.0 | 60.0 | 3.5 |
| Example 22 | Recrystallized SiC | 40 | Quadrangular | 1 | 47 | 0.3 | 50 | 30 | 75 | 1.7 | 60.0 | 2.1 |
| Example 23 | Recrystallized SiC | 40 | Quadrangular | 1 | 93 | 0.1 | 40 | 50 | 80 | 2.2 | 60.0 | 1.6 |
| Example 24 | Recrystallized SiC | 40 | Quadrangular | 1 | 93 | 0.1 | 50 | 30 | 75 | 3.7 | 60.0 | 1.0 |
| Example 25 | Recrystallized SiC | 40 | Quadrangular | 0.5 | 31 | 0.3 | 40 | 50 | 80 | 0.6 | 40.0 | 2.6 |
| Example 26 | Recrystallized SiC | 40 | Quadrangular | 0.5 | 31 | 0.3 | 50 | 30 | 75 | 1.0 | 40.0 | 1.5 |
| Example 27 | Recrystallized SiC | 40 | Quadrangular | 0.5 | 47 | 0.3 | 40 | 50 | 80 | 0.5 | 40.0 | 3.1 |
| Example 28 | Recrystallized SiC | 40 | Quadrangular | 0.5 | 47 | 0.3 | 50 | 30 | 75 | 0.9 | 40.0 | 1.9 |
| Example 29 | Recrystallized SiC | 40 | Quadrangular | 0.5 | 93 | 0.1 | 40 | 50 | 80 | 1.1 | 40.0 | 1.5 |
| Example 30 | Recrystallized SiC | 40 | Quadrangular | 0.5 | 93 | 0.1 | 50 | 30 | 75 | 1.8 | 40.0 | 0.9 |
| Example 31 | Recrystallized SiC | 40 | Quadrangular | 0.1 | 31 | 0.3 | 40 | 50 | 80 | 0.12 | 20.0 | 3.2 |
| Example 32 | Recrystallized SiC | 40 | Quadrangular | 0.1 | 31 | 0.3 | 50 | 30 | 75 | 0.21 | 20.0 | 1.9 |
| Example 33 | Recrystallized SiC | 40 | Quadrangular | 0.1 | 47 | 0.3 | 40 | 50 | 80 | 0.10 | 20.0 | 3.9 |
| Example 34 | Recrystallized SiC | 40 | Quadrangular | 0.1 | 47 | 0.3 | 50 | 30 | 75 | 0.17 | 20.0 | 2.3 |
| Example 35 | Recrystallized SiC | 40 | Quadrangular | 0.1 | 93 | 0.1 | 40 | 50 | 80 | 0.22 | 20.0 | 1.8 |
| Example 36 | Recrystallized SiC | 40 | Quadrangular | 0.1 | 93 | 0.1 | 50 | 30 | 75 | 0.37 | 20.0 | 1.1 |
| Example 37 | Reaction-sintered SiC (porous) | 40 | Quadrangular | 1 | 31 | 0.3 | 40 | 50 | 80 | 1.24 | 60.0 | 2.9 |
| Example 38 | Reaction-sintered SiC (porous) | 40 | Quadrangular | 1 | 31 | 0.3 | 50 | 30 | 75 | 2.09 | 60.0 | 1.7 |
| Example 39 | Reaction sintered SiC (porous) | 40 | Quadrangular | 1 | 47 | 0.3 | 40 | 50 | 80 | 1.02 | 60.0 | 3.5 |
| Example 40 | Reaction-sintered SiC (porous) | 40 | Quadrangular | 1 | 47 | 0.3 | 50 | 30 | 75 | 1.71 | 60.0 | 2.1 |

TABLE 2

| | Material | Porosity (%) | Cell shape | Specific electrical resistance (Ω · cm) | Cell density (cells/cm$^2$) | Partition wall thickness (mm) | Length of one side of cross section (mm) | Length of honeycomb structure section (mm) | Volume of honeycomb structure section (cm$^3$) | Resistance (Ω) | Voltage (V) | Output (kW) |
|---|---|---|---|---|---|---|---|---|---|---|---|---|
| Example 41 | Reaction-sintered SiC (porous) | 40 | Quadrangular | 1 | 93 | 0.1 | 40 | 50 | 80 | 2.19 | 60.0 | 1.6 |
| Example 42 | Reaction-sintered SiC (porous) | 40 | Quadrangular | 1 | 93 | 0.1 | 50 | 30 | 75 | 0.37 | 20.0 | 1.1 |

TABLE 2-continued

| | Material | Porosity (%) | Cell shape | Specific electrical resistance (Ω · cm) | Cell density (cells/cm$^2$) | Partition wall thickness (mm) | Length of one side of cross section (mm) | Length of honeycomb structure section (mm) | Volume of honeycomb structure section (cm$^3$) | Resistance (Ω) | Voltage (V) | Output (kW) |
|---|---|---|---|---|---|---|---|---|---|---|---|---|
| Example 43 | Reaction-sintered SiC (dense) | 0 | Quadrangular | 0.05 | 31 | 0.3 | 40 | 50 | 80 | 0.06 | 15.0 | 3.6 |
| Example 44 | Reaction-sintered SiC (dense) | 0 | Quadrangular | 0.05 | 31 | 0.3 | 50 | 30 | 75 | 0.10 | 15.0 | 2.2 |
| Example 45 | Reaction-sintered SiC (dense) | 0 | Quadrangular | 0.05 | 47 | 0.3 | 40 | 50 | 80 | 0.05 | 15.0 | 4.4 |
| Example 46 | Reaction-sintered SiC (dense) | 0 | Quadrangular | 0.05 | 47 | 0.3 | 50 | 30 | 75 | 0.09 | 15.0 | 2.6 |
| Example 47 | Reaction-sintered SiC (dense) | 0 | Quadrangular | 0.05 | 93 | 0.1 | 40 | 50 | 80 | 0.11 | 15.0 | 2.1 |
| Example 48 | Reaction-sintered SiC (dense) | 0 | Quadrangular | 0.05 | 93 | 0.1 | 50 | 30 | 75 | 0.18 | 15.0 | 1.2 |
| Example 49 | Reaction-sintered SiC (dense) | 0 | Quadrangular | 0.01 | 31 | 0.3 | 40 | 50 | 80 | 0.01 | 5.0 | 2.0 |
| Example 50 | Reaction-sintered SiC (dense) | 0 | Quadrangular | 0.01 | 31 | 0.3 | 50 | 30 | 75 | 0.02 | 5.0 | 1.2 |
| Example 51 | Reaction-sintered SiC (dense) | 0 | Quadrangular | 0.01 | 47 | 0.3 | 40 | 50 | 80 | 0.01 | 5.0 | 2.4 |
| Example 52 | Reaction-sintered SiC (dense) | 0 | Quadrangular | 0.01 | 47 | 0.3 | 50 | 30 | 75 | 0.02 | 5.0 | 1.5 |
| Example 53 | Reaction-sintered SiC (dense) | 0 | Quadrangular | 0.01 | 93 | 0.1 | 40 | 50 | 80 | 0.02 | 5.0 | 1.1 |
| Example 54 | Reaction-sintered SiC (dense) | 0 | Quadrangular | 0.01 | 93 | 0.1 | 50 | 30 | 75 | 0.04 | 5.0 | 0.7 |
| Example 55 | Si-bonded SiC | 40 | Hexagonal | 30 | 47 | 0.3 | 40 | 50 | 80 | 16 | 200.0 | 2.5 |
| Example 56 | Si-bonded SiC | 40 | Hexagonal | 30 | 47 | 0.3 | 50 | 30 | 75 | 28 | 200.0 | 1.4 |
| Example 57 | Si-bonded SiC | 40 | Hexagonal | 0.5 | 47 | 0.3 | 40 | 50 | 80 | 0.26 | 40.0 | 6.1 |
| Example 58 | Si-bonded SiC | 40 | Hexagonal | 0.5 | 47 | 0.3 | 50 | 30 | 75 | 0.46 | 40.0 | 3.5 |
| Example 59 | Si-impregnated SiC | 0 | Hexagonal | 0.05 | 47 | 0.3 | 40 | 50 | 80 | 0.03 | 10.0 | 3.8 |
| Example 60 | Si-impregnated SiC | 0 | Hexagonal | 0.05 | 47 | 0.3 | 50 | 30 | 75 | 0.05 | 10.0 | 2.2 |
| Example 61 | Recrystallized SiC | 40 | Hexagonal | 1 | 47 | 0.3 | 40 | 50 | 80 | 0.52 | 40.0 | 3.1 |
| Example 62 | Recrystallized SiC | 40 | Hexagonal | 1 | 47 | 0.3 | 50 | 30 | 75 | 0.92 | 40.0 | 1.7 |
| Example 63 | Recrystallized SiC | 40 | Hexagonal | 0.5 | 47 | 0.3 | 40 | 50 | 80 | 0.26 | 20.0 | 1.5 |
| Example 64 | Recrystallized SiC | 40 | Hexagonal | 0.5 | 47 | 0.3 | 50 | 30 | 75 | 0.46 | 20.0 | 0.9 |
| Example 65 | Recrystallized SiC | 40 | Hexagonal | 0.1 | 47 | 0.3 | 40 | 50 | 80 | 0.05 | 15.0 | 4.3 |
| Example 66 | Recrystallized SiC | 40 | Hexagonal | 0.1 | 47 | 0.3 | 50 | 30 | 75 | 0.09 | 15.0 | 2.4 |
| Example 67 | Reaction-sintered SiC (porous) | 40 | Hexagonal | 1 | 47 | 0.3 | 40 | 50 | 80 | 0.52 | 15.0 | 0.4 |
| Example 68 | Reaction-sintered SiC (porous) | 40 | Hexagonal | 1 | 47 | 0.3 | 50 | 30 | 75 | 0.92 | 15.0 | 0.2 |
| Example 69 | Reaction-sintered SiC (dense) | 0 | Hexagonal | 0.05 | 47 | 0.3 | 40 | 50 | 80 | 0.03 | 10.0 | 3.8 |
| Example 70 | Reaction-sintered SiC (dense) | 0 | Hexagonal | 0.05 | 47 | 0.3 | 50 | 30 | 75 | 0.05 | 10.0 | 2.2 |
| Example 71 | Reaction-sintered SiC (dense) | 0 | Hexagonal | 0.01 | 47 | 0.3 | 40 | 50 | 80 | 0.01 | 5.0 | 4.8 |

TABLE 2-continued

| | Material | Porosity (%) | Cell shape | Specific electrical resistance (Ω · cm) | Cell density (cells/cm$^2$) | Partition wall thickness (mm) | Length of one side of cross section (mm) | Length of honeycomb structure section (mm) | Volume of honeycomb structure section (cm$^3$) | Resistance (Ω) | Voltage (V) | Output (kW) |
|---|---|---|---|---|---|---|---|---|---|---|---|---|
| Example 72 | Reaction-sintered SiC (dense) | 0 | Hexagonal | 0.01 | 47 | 0.3 | 50 | 30 | 75 | 0.01 | 5.0 | 2.7 |
| Example 73 | $BaTiO_3$ | — | Quadrangular | 100 | 47 | 0.3 | 40 | 50 | 80 | 102 | 500.0 | 2.7 |
| Example 74 | $V_2O_3$ | — | Quadrangular | 0.001 | 47 | 0.3 | 40 | 50 | 80 | 0.0011 | 2.0 | 4.3 |

Examples 2 to 12 and 55 to 58

Heaters were prepared in the same manner as in Example 1 except that conditions of a honeycomb shape were changed as shown in Table 1 and materials for use were changed as follows. The prepared heaters were subjected to "an electrical conduction test" in the same manner as in Example 1. The results are shown in Tables 1 and 2.

Examples 13 to 18, 59 and 60

First, a honeycomb structure section containing Si-impregnated SiC as a main component was prepared. Specifically, SiC powder, an organic binder and water were mixed and kneaded to prepare a kneaded material. Next, this kneaded material was formed in a predetermined honeycomb shape shown in Table 1 or 2 to prepare a formed body. Next, on the obtained formed body, a lump of metal Si was mounted, and impregnated with Si in a reduced pressure argon (Ar) gas. Thus, the honeycomb structure section containing Si-impregnated SiC as a main component was prepared. Next, a coating film was formed in the same manner as in Example 1, to form a pair of electrodes on the side surface of the honeycomb structure section. In this way, heaters each including the honeycomb structure section and the pair of electrodes were prepared.

Next, the prepared heaters were subjected to "an electrical conduction test" in the same manner as in Example 1. The results are shown in Tables 1 and 2.

Examples 19 to 36 and 61 to 66

First, a honeycomb structure section containing recrystallized SiC as a main component was prepared. Specifically, SiC powder, an organic binder and water were mixed and kneaded to prepare a kneaded material. Next, this kneaded material was formed in a predetermined honeycomb shape shown in Table 1 or 2 to prepare a formed body. Next, the obtained formed body was sintered in a nitrogen gas atmosphere. Thus, the honeycomb structure section containing recrystallized SiC as the main component was prepared. Next, a coating film was formed in the same manner as in Example 1, to form a pair of electrodes on the side surface of the honeycomb structure section. In this way, heaters each including the honeycomb structure section and the pair of electrodes were prepared.

Next, the prepared heaters were subjected to "an electrical conduction test" in the same manner as in Example 1. The results are shown in Tables 1 and 2.

Examples 37 to 42 and 67 and 68

First, a honeycomb structure section containing porous reaction-sintered SiC as a main component was prepared. Specifically, silicon nitride powder, carbon black, silicon carbide and graphite powder were mixed and kneaded to prepare a kneaded material. Next, this kneaded material was formed in a predetermined honeycomb shape shown in Table 1 or 2 to prepare a formed body. Next, the obtained formed body was primarily sintered in a non-oxidation atmosphere to obtain a primary sintered body. Next, the obtained primary sintered body was decarburized in the atmospheric air, to remove residual graphite. Afterward, the body was secondarily sintered at 2000° C. in the non-oxidation atmosphere. Thus, the honeycomb structure section containing porous reaction-sintered SiC as the main component was prepared. Next, a coating film was formed in the same manner as in Example 1, to form a pair of electrodes on the side surface of the honeycomb structure section. In this way, heaters each including the honeycomb structure section and the pair of electrodes were prepared.

Next, the prepared heaters were subjected to "an electrical conduction test" in the same manner as in Example 1. The results are shown in Tables 1 and 2.

Examples 43 to 54 and 69 to 72

First, a honeycomb structure section containing dense reaction-sintered SiC as a main component was prepared. Specifically, SiC powder and graphite powder were mixed and kneaded to prepare a kneaded material. Next, this kneaded material was formed in a predetermined honeycomb shape shown in Table 1 or 2, to prepare a formed body. On the obtained formed body, a lump of metal Si was mounted, and the body was impregnated in a reduced argon (Ar) atmosphere. Thus, the honeycomb structure section containing dense reaction-sintered SiC as the main component was prepared. Next, a coating film was formed in the same manner as in Example 1, to form a pair of electrodes on the side surface of the honeycomb structure section. In this way, heaters each including the honeycomb structure section and the pair of electrodes were prepared.

Next, the prepared heaters were subjected to "an electrical conduction test" in the same manner as in Example 1. The results are shown in Tables 1 and 2.

Examples 73 and 74

A material shown in Table 2 (barium titanate ($BaTiO_3$) or vanadium trioxide ($V_2O_3$)) was mixed with a sintering aid, water and an organic binder, and kneaded to prepare a kneaded material. Next, this kneaded material was formed in a predetermined honeycomb shape shown in Table 2, to prepare a formed body. The obtained formed body was sintered in the atmospheric air. Thus, a honeycomb structure section containing $BaTiO_3$ or $V_2O_3$ as a main component was prepared. Next, a coating film was formed in the same manner as in Example 1, to form a pair of electrodes on the side surface of the honeycomb structure section. In this way, heaters each including the honeycomb structure section and the pair of electrodes were prepared.

Next, the prepared heaters were subjected to "an electrical conduction test" in the same manner as in Example 1. The results are shown in Table 2.

The heater of Example 73 is typically known usually as PTC heater. The heater of Example 73 is an example of a heater having a specific electrical resistance larger than "50 Ω·cm". The electrical resistance of this heater of Example 73 is excessively large. Consequently, for obtaining a practical output (1 to 5 kW), it is necessary to apply a high voltage to the heater. Therefore, the heater of Example 73 having the specific electrical resistance larger than "50 Ω·cm" lacks in practicality, when an on-vehicle application is taken into consideration.

and it is evaluated whether or not the heating can be performed from room temperature to 60° C.

It has been found that the heater of Example 75 can raise the temperature of the engine oil "from room temperature to 60° C." in 108 seconds, when an operation voltage (Table 2 simply shows "voltage") in the temperature rise confirming test is 200 V. Therefore, it has been found that when the heater of Example 75 is formed in a honeycomb type structure (a honeycomb shape including a plurality of cells), the heater becomes compact, while the temperature of a lubricating fluid as the engine oil can rapidly be raised. Moreover, in Example 76, a specific electrical resistance of Si-bonded SiC is lowered. When the specific electrical resistance of Si-bonded SiC was lowered in this manner and the operation voltage was decreased to 40 V in a light electrical power range of 60 V or smaller, it was still possible to raise the temperature of the engine oil "from room temperature to 60° C." in 199 seconds.

TABLE 3

| Material | Porosity (%) | Cell shape | Specific electrical resistance (Ω · cm) | Cell density (cells/cm$^2$) | Partition wall thickness (mm) | Length of one side of cross section (mm) | Length of honeycomb structure section (mm) | Volume of honeycomb structure section (cm$^3$) | Resistance (Ω) | Voltage (V) | Flow rate (L/min) | Output (kW) |
|---|---|---|---|---|---|---|---|---|---|---|---|---|
| Si-bonded SiC | 40 | Quadrangular | 30 | 47 | 0.3 | 40 | 50 | 80 | 31 | 200 | 10 | 1.3 |
| Si-bonded SiC | 40 | Quadrangular | 0.5 | 47 | 0.3 | 40 | 50 | 80 | 0.51 | 40 | 10 | 0.3 |

The heater of Example 74 is an example of a specific electrical resistance smaller than "0.01 Ω·cm". The electrical resistance of the heater of Example 74 is excessively small. Consequently, for obtaining a practical output (1 to 5 kW), it is necessary to supply a large current (2000 A or larger in the present example). Therefore, when it is considered that an electric line portion to be connected releases heat, the electric line portion has a large bore diameter. In consequence, the electric line portion becomes bulky, and a weight increases. Therefore, the heater of Example 74 having the specific electrical resistance smaller than "0.01 Ω·cm" lacks in practicality, when the on-vehicle application is taken into consideration.

Examples 75 and 76

Heaters were prepared in the same manner as in Example 1 except that conditions were changed as shown in Table 3. The obtained heaters were subjected to "a temperature rise confirming test" as a principle test by the following method.

(Temperature Rise Confirming Test)

As a lubricating fluid, an engine oil is typically used. First, as a temperature rise confirming test device, an oil pump and a pipe interconnected to a flow meter are prepared. Next, the pipe of the temperature rise confirming test device is connected to a housing in which a heater is placed. In this way, a structure through which the engine oil circulates is obtained. The heater is connected to a direct-current power source, and the direct-current is supplied with a constant voltage. Here, thermocouples are arranged before and after the housing in which the heater is placed (i.e. positions on inlet and outlet sides of the housing), to measure a temperature of the engine oil. The temperature of the engine oil is measured to evaluate whether or not heating can be performed. In the present test, a supply flow rate of the engine oil is about 10 L/min. The engine oil to be circulated is "Mobil 1" manufactured by Exxon Mobile Co. An amount of the engine oil is 1000 cm$^3$,

Example 77

First, a honeycomb structure section containing Si-bonded SiC as a main component was prepared in the same manner as in Example 1 except that a cell density of the prepared honeycomb structure section became 47 cells/cm$^2$. Next, a colloidal solution containing insulating particles was poured into cells of this honeycomb structure section, to form a coating layer of the colloid surface on the surfaces of partition walls. Next, "the honeycomb structure section provided with the coating layer" was heated and dried by high-frequency dielectric heating, and then dried at 120° C. by use of a hot air drier. As "the colloidal solution containing the insulating particles", a solution containing aluminum acetyl acenato ($Al(C_5H_7O_2)_3$) rosemary oil and acetyl acetone as main components was used. Afterward, the temperature was raised to 1300° C. in an atmospheric furnace to sinter "the dried coating layer". In this way, a densified insulating layer was formed on the surfaces of the partition walls of the honeycomb structure section. A main component of the insulating layer was $Al_2O_3$. Moreover, this insulating layer slightly reacted with Si-bonded SiC constituting the honeycomb structure section. Therefore, on an interface between the insulating layer and the partition wall of the honeycomb structure section, an $Al_2O_3$—$SiO_2$ layer was formed.

Next, the insulating layer was also formed on the side surface of the honeycomb structure section, and hence this insulating layer was removed. Specifically, the mutually parallel side surfaces of the honeycomb structure section provided with the insulating layer were mechanically processed, respectively, to remove the insulating layer from portions to be provided with electrodes, thereby exposing an outer peripheral wall of the honeycomb structure section. Afterward, the exposed outer peripheral wall was coated with a silver (Ag) paste which was an electrode forming raw material. A shape of a coating film was rectangular (a strip-like shape). Afterward, in the same manner as in Example 1, degreasing was carried out in an atmospheric furnace, and then sintering was carried out, to prepare a heater including the honeycomb structure section coated with the insulating layer, and a pair of electrodes. The Ag paste is a paste-like material made of 40 to 95 mass % of silver.

The insulating layer in the heater of the present example had a dielectric breakdown strength of 16 V/μm. An average film thickness of the insulating layer was 10 μm. The column of "an average film thickness" in Table 4 shows "the average film thickness of the insulating layer". A withstand voltage of the insulating layer was 160 V. "The average film thickness" of the insulating layer is a value measured by preparing "a cross section sample" and observing an insulating layer in this cross section sample by use of a scanning electron microscope (SEM) and an optical microscope (OM). Moreover, "the withstand voltage" of the insulating layer was measured by a method shown in JIS C 2141. Specifically, first, the heater was cut so as to expose the insulating layer formed on the surfaces of the partition walls, to cut a plate-like test piece from the heater. The insulating layers were arranged on the front surface and back surface of this plate-like test piece. Next, a direct-current withstand voltage tester was used, and a probe of the direct-current withstand voltage tester was attached to the front surface and the back surface of the cut test piece, respectively, to raise a voltage at a rate of 10 V/second. Afterward, when the test piece broke down and short-circuited, the value of the voltage was read. The measuring was carried out ten times, to obtain an average value as the measured value of the dielectric breakdown voltage. The results are shown in Table 4.

TABLE 4

| | Insulating layer (main component) | Dielectric breakdown strength (V/μm) | Ave. film thickness (μm) | Withstand voltage (V) |
|---|---|---|---|---|
| Example 77 | $Al_2O_3$ | 16 | 10 | 160 |
| Example 78 | MgO | 20 | 10 | 200 |
| Example 79 | $SiO_2$ | 1000 | 10 | 10000 |
| Example 80 | $SiO_2$ | 1000 | 1 | 1000 |
| Example 81 | $SiO_2$ | 1000 | 0.1 | 100 |
| Example 82 | AlN | 27 | 10 | 270 |
| Example 83 | $Si_3N_4$ | 18 | 10 | 180 |
| Example 84 | $SiO_2$ | 870 | 1 | 870 |

Examples 78 to 81

Heaters were prepared in the same manner as in Example 77 except that a colloidal solution of an insulating layer was changed to an Mg or Si-containing colloidal solution so as to obtain an insulating layer made of a main component shown in Table 4. "A dielectric breakdown strength", "an average film thickness" and "a withstand voltage" of the insulating layer in each of the obtained heaters are shown in Table 4.

Examples 82 and 83

First, in the same manner as in Example 77, a honeycomb structure section containing Si-bonded SiC as a main component was prepared. Next, the surfaces of partition walls of the honeycomb structure section were coated with an Al or Si-containing colloidal solution to form a coating layer of the colloidal solution, by using the colloidal solution so that an insulating layer contained a main component shown in Table 4. Next, "the honeycomb structure section provided with the coating layer" was heated and dried by high-frequency dielectric heating, and then dried at 120° C. by use of a hot air drier. Afterward, the temperature was raised to 1300° C. while allowing an $N_2$ gas to flow through a carbon furnace to obtain a reducing atmosphere, to nitride "the dried coating layer", thereby forming the insulating layer. In this way, the insulating layer was formed on the surfaces of the partition walls of the honeycomb structure section. Afterward, electrodes were prepared in the same manner as in Example 77. Thus, heaters were prepared. "A dielectric breakdown strength", "an average film thickness" and "a withstand voltage" of the insulating layer in each of the obtained heaters are shown in Table 4.

Example 84

In the same manner as in Example 1, "a honeycomb structure section coated with an electrode forming raw material" was prepared. The obtained "honeycomb structure section coated with the electrode forming raw material" was sintered at 1300° C. in a water vapor atmosphere. When "the honeycomb structure section coated with the electrode forming raw material" was sintered, SiC constituting partition walls was oxidized, to form an oxide film containing $SiO_2$ as a main component on the surfaces of the partition walls. In this way, there was prepared a heater including the honeycomb structure section and a pair of electrodes and including an insulating layer formed on the surfaces of the partition walls of the honeycomb structure section. An average film thickness of the insulating layer was 1 μm. A withstand voltage of the insulating layer was 870V. The insulating layer had a dielectric breakdown strength of 870 V/μm.

INDUSTRIAL APPLICABILITY

The present invention can be utilized as a heater usable for heating a lubricating fluid such as an engine oil or a transmission fluid.

DESCRIPTION OF REFERENCE SIGNS

1: heater, 3: outer peripheral wall, 4: electrode, 4*a*: anode, 4*b*: cathode, 5: cell, 6: honeycomb structure section, 7: partition wall, 9, 9*a* and 9*b*: end, 21: heater, 23: outer peripheral wall, 24: electrode, 24*a*: anode, 24*b*: cathode, 25: cell, 26: honeycomb structure section, 27: partition wall, 28: insulating layer, 29, 29*a* and 29*b*: end, 31, 41, 51, 61, 71, 81, 91 and 101: heater, 33, 43, 53, 63, 73, 83 and 93: outer peripheral wall, 34, 44, 54, 64, 74, 84 and 94: electrode, 34*x*, 34*y*, 34*z* and 34*w*: end of electrode, 35, 45, 55, 65, 75, 85 and 95: cell, 36, 46, 56, 66, 76, 86 and 96: honeycomb structure section, 37, 47, 57, 67, 77, 87 and 97: partition wall, 98: current collecting layer, xz and yw: segment, Cxz and Cyw: midpoint, L1: straight line, and D: direction orthogonal to straight line L1.

What is claimed is:

1. A heater comprising:

a honeycomb structure section including partition walls which contain a ceramic as a main component and generate heat by electrical conduction, and a plurality of cells which are partitioned and formed by the partition walls and extend through the honeycomb structure section from one end thereof to the other end to become through channels of oil;

a pair of electrodes which become an anode and a cathode to come in contact with the honeycomb structure section, thereby conducting the electricity through the partition walls of the honeycomb structure section, wherein two or more rows of cells are arranged adjacent to one another in an uninterrupted manner from one electrode to the other electrode of the pair of electrodes.

2. The heater according to claim 1, wherein in the honeycomb structure section, thicknesses of the partition walls are from 0.1 to 0.51 mm, and a cell density is from 15 to 280 cells/$cm^2$.

3. The heater according to claim 1, wherein in the honeycomb structure section, specific electrical resistances of the partition walls are from 0.01 to 50 Ω·cm.

4. The heater according to claim 2, wherein in the honeycomb structure section, specific electrical resistances of the partition walls are from 0.01 to 50 Ω·cm.

5. The heater according to claim 1, wherein the partition walls contain, as the main component, one selected from the group consisting of SiC, metal-impregnated SiC, metal-bonded SiC, and metal-bonded $Si_3N_4$.

6. The heater according to claim 4, wherein the partition walls contain, as the main component, one selected from the group consisting of SiC, metal-impregnated SiC, metal-bonded SiC, and metal-bonded $Si_3N_4$.

7. The heater according to claim 1, which does not include partition walls orthogonal to a direction from the one electrode to the other electrode, in a cross section orthogonal to an extending direction of the cells.

8. The heater according to claim 6, which does not include partition walls orthogonal to a direction from the one electrode to the other electrode, in a cross section orthogonal to an extending direction of the cells.

9. The heater according to claim 1, wherein the surfaces of the partition walls include an insulating layer having a dielectric breakdown strength of 10 to 1000 V/μm.

10. The heater according to claim 8, wherein the surfaces of the partition walls include an insulating layer having a dielectric breakdown strength of 10 to 1000 V/μm.

11. The heater according to claim 1, wherein all of the partition walls are configured to be heated by electrical conduction.

12. The heater according to claim 1, wherein the length of the electrodes in the cell extending direction is the same length as the length of the honeycomb structure section in the cell extending direction.

13. The heater according to claim 1, wherein the cells are arranged adjacent to one another in an uninterrupted manner from one electrode of the pair of electrodes to the other electrode of the pair of electrodes.

* * * * *

UNITED STATES PATENT AND TRADEMARK OFFICE

CERTIFICATE OF CORRECTION

PATENT NO. : 8,907,256 B2
APPLICATION NO. : 13/423531
DATED : December 9, 2014
INVENTOR(S) : Shigeharu Hashimoto et al.

It is certified that error appears in the above-identified patent and that said Letters Patent is hereby corrected as shown below:

Title Page, Item (56), Other Publications:

Please add: "Extended European Search Report (Application No. 12159853.6) dated October 2, 2014."

Signed and Sealed this
Twenty-first Day of April, 2015

Michelle K. Lee

Michelle K. Lee
*Director of the United States Patent and Trademark Office*